US007257347B2

(12) United States Patent
Okamoto

(10) Patent No.: US 7,257,347 B2
(45) Date of Patent: Aug. 14, 2007

(54) DEVELOPER CONTAINING DEVICE, IMAGE FORMING APPARATUS, AND IMAGE FORMING SYSTEM WITH HOUSING SECTIONS WELDED TOGETHER BY VIBRATION WELDING

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 192 days.

(21) Appl. No.: 11/056,353

(22) Filed: Feb. 11, 2005

(65) Prior Publication Data

US 2005/0180775 A1 Aug. 18, 2005

(30) Foreign Application Priority Data

Feb. 13, 2004 (JP) ..... 2004-037138
Feb. 13, 2004 (JP) ..... 2004-037139

(51) Int. Cl.
*G03G 15/00* (2006.01)
*G03G 15/08* (2006.01)

(52) U.S. Cl. ..... 399/109; 399/119

(58) Field of Classification Search ..... 399/109, 399/111, 113, 119
See application file for complete search history.

(56) References Cited

U.S. PATENT DOCUMENTS 6,215,969 B1 4/2001 Nomura et al.
6,577,830 B1 * 6/2003 Wazana et al. ..... 399/109
6,684,039 B1 * 1/2004 Wazana et al. ..... 399/109

FOREIGN PATENT DOCUMENTS

| | | |
|---|---|---|
| EP | 0 834 781 | 4/1998 |
| EP | 1 341 061 | 9/2003 |
| JP | 05-216302 | 8/1993 |
| JP | 09-197792 | 7/1997 |
| JP | 11-143203 | 5/1999 |
| JP | 2002-108175 | 4/2002 |
| JP | 2004-163470 | 6/2004 |

OTHER PUBLICATIONS

Partial European Search Report (Jun. 9, 2005).
European Search Report (Oct. 5, 2005).

* cited by examiner

*Primary Examiner*—William J. Royer
(74) *Attorney, Agent, or Firm*—Hogan & Hartson LLP

(57) ABSTRACT

A developer containing device is provided with a housing that includes a first housing section and a second housing section and that is configured to contain a developer. A protrusion provided on the first housing section and a recess provided in the second housing section are welded together through vibration welding in a state where the protrusion is fitted into the recess. An outer wall of the recess is thicker than an inner wall of the recess.

21 Claims, 15 Drawing Sheets

DEVELOPER CONTAINING DEVICE, IMAGE FORMING APPARATUS, AND IMAGE FORMING SYSTEM WITH HOUSING SECTIONS WELDED TOGETHER BY VIBRATION WELDING

CROSS-REFERENCE TO RELATED APPLICATION

The present application claims priority upon Japanese Patent Application No. 2004-37138 filed on Feb. 13, 2004 and Japanese Patent Application No. 2004-37139 filed on Feb. 13, 2004, which are herein incorporated by reference.

BACKGROUND OF THE INVENTION

1. Field of the Invention

The present invention relates to developer containing devices, image forming apparatuses, and image forming systems.

2. Description of the Related Art

Image forming apparatuses such as laser beam printers are well known in the art. Such image forming apparatuses are provided with, for example, a photoconductor which is an example of an image bearing body for bearing a latent image, and a developer containing device having a housing configured to contain a developer. When the image forming apparatus receives image signals from an external device such as a host computer, the latent image borne on the photoconductor is developed with the developer in the developer containing device to form a developer image, the developer image is transferred onto a medium, and ultimately an image is formed on the medium.

Further, the housing provided in the developer containing device includes a first housing section and a second housing section, and the housing is formed by welding together a protrusion provided on the first housing section and a recess provided in the second housing section in a state where the protrusion is fitted into the recess.

An effective method for welding the second housing section to the first housing section is the so-called "vibration welding". In vibration welding, the first housing section and the second housing section are each fixed to and held by different jigs, and in a state where both housing sections are pressed in contact with one another, one of the jigs is vibrated in a predetermined vibration direction. Due to this vibration, frictional heat is produced between the housing sections, and due to this frictional heat, the protrusion melts, and thereby the first housing section and the second housing section are welded together. In this way, the first housing section and the second housing section can be welded reliably, and a desired housing can be obtained. (See, for example, JP 5-216302 A.)

The first housing section and the second housing section are welded by the protrusion melting during vibration welding. The melt, which is produced as a result of the protrusion melting, is located in a gap between the protrusion and the recess. Often, there is a variation in the amount of melt that is produced during vibration welding. If the amount of melt is large, then a force is generated in such a direction that the melt presses the walls (the outer wall and the inner wall) that structure the recess away from the protrusion. On the other hand, if the amount of melt is small then a force is generated in such a direction that the melt pulls the walls (the outer wall and the inner wall) that structure the recess toward the protrusion.

Meanwhile, it is necessary to prevent the outer wall, of among the walls of the recess, from deforming due to such a force because, for example, the outer wall can be visually observed and also because other components may be fixed thereto.

(2) Another type of image forming apparatus is provided with, for example, a photoconductor which is an example of an image bearing body for bearing a latent image, and a developing device which is an example of a developer containing device having a housing configured to contain a developer and which develops the latent image borne on the photoconductor with the developer. When the image forming apparatus receives image signals from an external device such as a host computer, the latent image borne on the photoconductor is developed with the developer in the developing device to form a developer image, the developer image is transferred onto a medium, and ultimately an image is formed on the medium.

Further, the housing of the developing device includes a first housing section and a second housing section, and the housing is formed by welding together the first housing section and the second housing section. An effective method for welding the second housing section to the first housing section is the so-called "vibration welding". In vibration welding, the first housing section and the second housing section are each fixed to and held by different jigs, and in a state where both housing sections are pressed in contact with one another, one of the jigs is vibrated in a predetermined vibration direction. Due to this vibration, frictional heat is produced between the housing sections, and due to this frictional heat, a portion of the housing section melts, and the first housing section and the second housing section are welded together. In this way, the first housing section and the second housing section can be welded reliably, and a desired housing can be obtained.

Further, the developing device may be provided with an attachment member that is attached to the second housing section, and that is provided extending across the first housing section and the second housing section on a side surface of the housing that intersects with the vibration direction. A shaft-receiving member for receiving a rotation shaft of a developer bearing body provided in the developing device can be given as an example of the attachment member. (See, for example, JP 5-216302 A.)

Since, however, the above-described attachment member is attached to the second housing section and is provided extending across the first housing section and the second housing section on the side surface of the housing that intersects with the vibration direction, the attachment member may become deformed if the first housing section physically interferes with the attachment member when it is attached to the second housing section.

Therefore, it is required that the first housing section does not physically interfere with the attachment member when the attachment member is attached to the second housing section of the housing that is formed by welding the first housing section and the second housing section together through vibration welding.

SUMMARY OF THE INVENTION

The present invention has been made in light of the foregoing issues. It is an object of the present invention to achieve a developer containing device, an image forming apparatus, and an image forming system with which it is possible to appropriately prevent deformation of an outer wall of a recess provided in a second housing section.

Another object of the present invention is to appropriately prevent physical interference between a first housing section and an attachment member.

An aspect of the present invention is a developer containing device comprising: a housing that includes a first housing section and a second housing section and that is configured to contain a developer, wherein a protrusion provided on the first housing section and a recess provided in the second housing section are welded together through vibration welding in a state where the protrusion is fitted into the recess, and wherein an outer wall of the recess is thicker than an inner wall of the recess.

Another aspect of the present invention is a developer containing device comprising: a housing that includes a first housing section and a second housing section and that is configured to contain a developer, wherein the first housing section and the second housing section are welded together through vibration welding; and an attachment member that is attached to the second housing section, and that is provided extending across the first housing section and the second housing section on a side surface of the housing that intersects with a predetermined vibration direction of a vibration that is applied to at least one of the first housing section and the second housing section during the vibration welding; wherein a length from a first side surface of the first housing section up to a first opposite-side side surface that is on the opposite side from the first side surface is shorter than a length from a second side surface of the second housing section up to a second opposite-side side surface that is on the opposite side from the second side surface, the first side surface and the second side surface being a portion of the side surface on which the attachment member is provided.

Other features of the present invention will be made clear through the accompanying drawings and the following description.

DETAILED DESCRIPTION OF THE INVENTION

Figure 1:
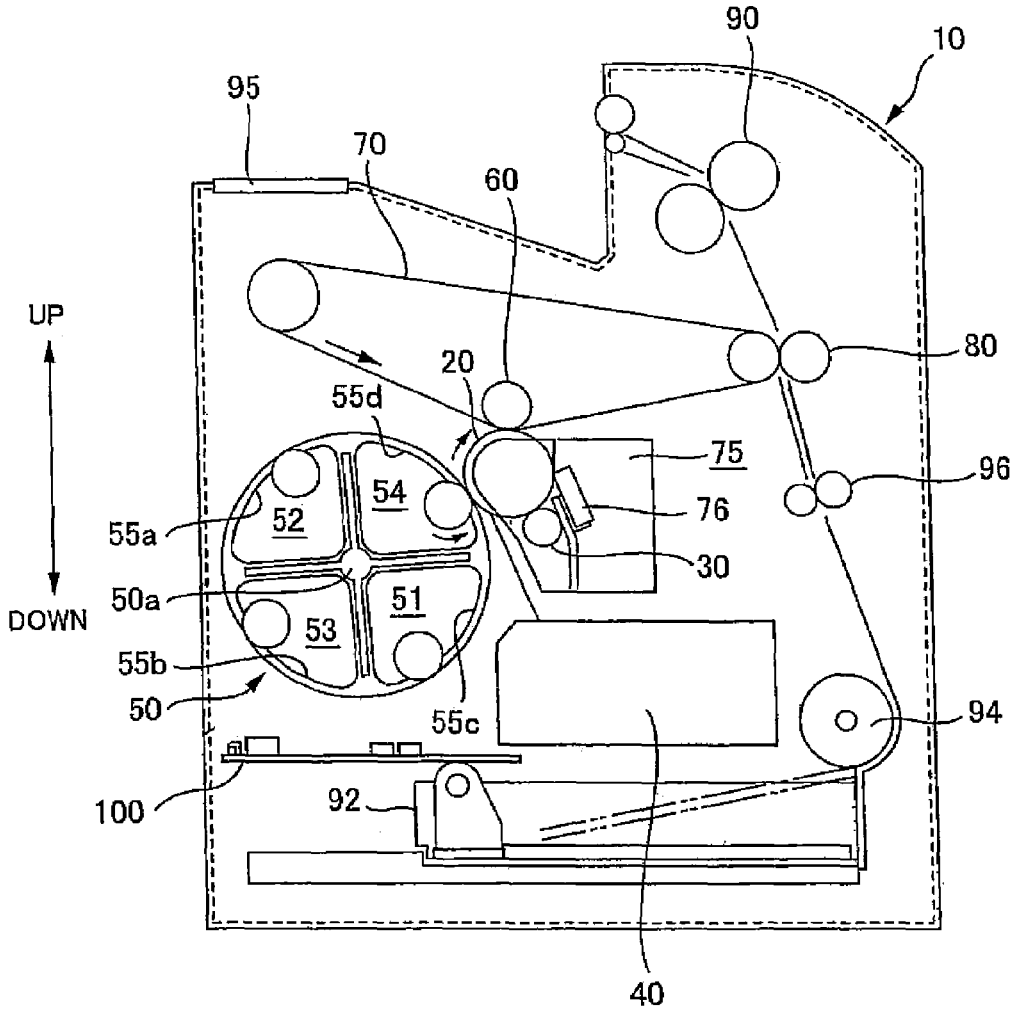
FIG. 1 is a diagram showing main structural components constructing a printer.

At least the following matters will become clear by the explanation in the present specification and the description of the accompanying drawings.

(1) An aspect of the present invention is a developer containing device comprising: a housing that includes a first housing section and a second housing section and that is configured to contain a developer, wherein a protrusion provided on the first housing section and a recess provided in the second housing section are welded together through vibration welding in a state where the protrusion is fitted into the recess, and wherein an outer wall of the recess is thicker than an inner wall of the recess.

In this way, it is possible to achieve a developer containing device in which deformation of the outer wall of the recess provided in the second housing section is appropriately prevented.

Further, the first housing section may include: a vibration-direction protrusion arranged in a predetermined vibration direction of a vibration that is applied to at least one of the first housing section and the second housing section during the vibration welding, and a perpendicular-direction protrusion arranged in a direction that is perpendicular to the predetermined vibration direction; the second housing section may include: a vibration-direction recess arranged in the predetermined vibration direction, and a perpendicular-direction recess arranged in the direction perpendicular to the predetermined vibration direction; the vibration-direction protrusion and the vibration-direction recess may be welded together through vibration welding in a state where the vibration-direction protrusion is fitted into the vibration-direction recess; the perpendicular-direction protrusion and the perpendicular-direction recess may be welded together through vibration welding in a state where the perpendicular-direction protrusion is fitted into the perpendicular-direction recess; and an outer wall of at least one of the vibration-direction recess and the perpendicular-direction recess may be thicker than an inner wall of that recess.

In this case, it is possible to achieve a developer containing device in which deformation of the outer wall of at least one of the vibration-direction recess and the perpendicular-direction recess provided in the second housing section is appropriately prevented.

Further, the outer wall of the perpendicular-direction recess may be thicker than the inner wall of the perpendicular-direction recess.

When comparing the welding between the vibration-direction protrusion and the vibration-direction recess and the welding between the perpendicular-direction protrusion and the perpendicular-direction recess, the protrusion of the perpendicular-direction protrusion and the perpendicular-direction recess is less prone to melting because they are not arranged in the predetermined vibration direction, and thus, a variation in the amount of melt is likely to occur. In view of this, by adopting the present invention for the perpendicular-direction recess, the above-described effect, that is, the effect that deformation of the outer wall of the recess is appropriately prevented, is more advantageously achieved.

Further, the predetermined vibration direction may be in a longitudinal direction of the developer containing device.

In this case, vibration welding of the housing can be performed more conveniently and appropriately.

Further, the developer containing device may be attachable to and detachable from an image forming apparatus that forms an image using the developer contained in the developer containing device.

In this case, the outer wall of the recess provided in the second housing section is visually observed more often. Therefore, the above-described effect, that is, the effect that deformation of the outer wall of the recess is appropriately prevented, is more advantageously achieved.

Further, the developer containing device may be provided with a developer bearing body for bearing the developer, and may be a developing device that develops a latent image borne on an image bearing body using the developer borne on the developer bearing body.

In this way, it is possible to achieve a developing device in which deformation of the outer wall of the recess provided in the second housing section is appropriately prevented.

Further, the developer containing device may be provided with a developer-removing member for removing the developer, and may be a removed-developer containing device that contains the developer that has been removed by the developer-removing member.

In this way, it is possible to achieve a removed-developer containing device in which deformation of the outer wall of the recess provided in the second housing section is appropriately prevented.

It is also possible to achieve a developer containing device comprising: a housing that includes a first housing section and a second housing section and that is configured to contain a developer, wherein a protrusion provided on the first housing section and a recess provided in the second housing section are welded together through vibration welding in a state where the protrusion is fitted into the recess, and wherein an outer wall of the recess is thicker than an inner wall of the recess; wherein the first housing section includes: a vibration-direction protrusion arranged in a predetermined vibration direction of a vibration that is applied to at least one of the first housing section and the second housing section during the vibration welding, and a perpendicular-direction protrusion arranged in a direction that is perpendicular to the predetermined vibration direction; wherein the second housing section includes: a vibration-direction recess arranged in the predetermined vibration direction, and a perpendicular-direction recess arranged in the direction perpendicular to the predetermined vibration direction; wherein the vibration-direction protrusion and the vibration-direction recess are welded together through vibration welding in a state where the vibration-direction protrusion is fitted into the vibration-direction recess; wherein the perpendicular-direction protrusion and the perpendicular-direction recess are welded together through vibration welding in a state where the perpendicular-direction protrusion is fitted into the perpendicular-direction recess; wherein an outer wall of at least one of the vibration-direction recess and the perpendicular-direction recess is thicker than an inner wall of that recess; wherein the outer wall of the perpendicular-direction recess is thicker than the inner wall of the perpendicular-direction recess; wherein the predetermined vibration direction is in a longitudinal direction of the developer containing device; wherein the developer containing device is attachable to and detachable from an image forming apparatus that forms an image using the developer contained in the developer containing device; and wherein the developer containing device is provided with a developer bearing body for bearing the developer, and is a developing device that develops a latent image borne on an image bearing body using the developer borne on the developer bearing body.

In this way, the object of the present invention is achieved more advantageously because almost all of the effects described above can be obtained.

It is also possible to achieve an image forming apparatus comprising: a developer containing device that is provided with a housing that includes a first housing section and a second housing section and that is configured to contain a developer, wherein a protrusion provided on the first housing section and a recess provided in the second housing section are welded together through vibration welding in a state where the protrusion is fitted into the recess, and wherein an outer wall of the recess is thicker than an inner wall of the recess.

In this way, it is possible to achieve an image forming apparatus that has a developer containing device in which deformation of the outer wall of the recess provided in the second housing section is appropriately prevented.

It is also possible to achieve an image forming system comprising: a computer; and an image forming apparatus that is configured to be connected to the computer and that includes a developer containing device provided with a housing that includes a first housing section and a second housing section and that is configured to contain a developer, wherein a protrusion provided on the first housing section and a recess provided in the second housing section are welded together through vibration welding in a state where the protrusion is fitted into the recess, and wherein an outer wall of the recess is thicker than an inner wall of the recess.

In this way, it is possible to achieve an image forming system that has a developer containing device in which deformation of the outer wall of the recess provided in the second housing section is appropriately prevented.

(2) Another aspect of the present invention is a developer containing device comprising: a housing that includes a first housing section and a second housing section and that is configured to contain a developer, wherein the first housing section and the second housing section are welded together through vibration welding; and an attachment member that is attached to the second housing section, and that is provided extending across the first housing section and the second housing section on a side surface of the housing that intersects with a predetermined vibration direction of a vibration that is applied to at least one of the first housing section and the second housing section during the vibration welding; wherein a length from a first side surface of the first housing section up to a first opposite-side side surface that is on the opposite side from the first side surface is shorter than a length from a second side surface of the second housing section up to a second opposite-side side surface that is on the opposite side from the second side surface, the first side surface and the second side surface being a portion of the side surface on which the attachment member is provided.

With this developer containing device, physical interference between the first housing section and the attachment member is appropriately prevented.

Further, a difference between the length from the first side surface up to the first opposite-side side surface and the length from the second side surface up to the second opposite-side side surface may be larger than an amplitude value of the vibration that is applied to at least one of the first housing section and the second housing section during the vibration welding.

In this way, it is possible to appropriately prevent physical interference between the first housing section and the attachment member, even when the relative position of the first housing section to the second housing section of the housing that has been vibration-welded deviates from the desired relative position.

Further, either one of the first housing section and the second housing section may be provided with a protrusion, and the other may be provided with a recess; and the protrusion and the recess may be welded together through vibration welding in a state where the protrusion is fitted into the recess.

In this way, vibration welding of the housing can be performed more conveniently and appropriately.

Further, the first housing section may include: a vibration-direction protrusion arranged in the vibration direction, and a perpendicular-direction protrusion arranged in a direction that is perpendicular to the vibration direction; the second housing section may include: a vibration-direction recess arranged in the vibration direction, and a perpendicular-direction recess arranged in the direction perpendicular to the vibration direction; the vibration-direction protrusion and the vibration-direction recess may be welded together through vibration welding in a state where the vibration-direction protrusion is fitted into the vibration-direction recess; the perpendicular-direction protrusion and the perpendicular-direction recess may be welded together through vibration welding in a state where the perpendicular-direction protrusion is fitted into the perpendicular-direction recess; and the difference between the length from the first side surface up to the first opposite-side side surface and the length from the second side surface up to the second opposite-side side surface may be larger than a difference between a distance, in the vibration direction, from an inner wall to an outer wall of the perpendicular-direction recess and a thickness of the perpendicular-direction protrusion in the vibration direction.

In this way, it is possible to appropriately prevent physical interference between the first housing section and the attachment member, even when the amplitude of the vibration when performing vibration welding becomes larger than the amplitude value that has been set.

Further, the attachment member may be in contact with the second side surface.

Further, a normal direction of a side surface, of among side surfaces of the attachment member, that is closer to the housing may be in a normal direction of the second side surface.

Further, the vibration direction may be in a longitudinal direction of the developer containing device.

In this way, vibration welding of the housing can be performed more conveniently and appropriately.

Further, the developer containing device may be provided with a developer bearing body for bearing the developer, and may be a developing device that develops a latent image borne on an image bearing body using the developer borne on the developer bearing body.

With this developing device, physical interference between the first housing section and the attachment member is appropriately prevented.

Further, the developer bearing body may have a rotation shaft; and the attachment member may be a shaft-receiving member for receiving the rotation shaft.

With this developing device, physical interference between the first housing section and the shaft-receiving member is appropriately prevented.

It is also possible to achieve a developer containing device comprising: a housing that includes a first housing section and a second housing section and that is configured to contain a developer, wherein the first housing section and the second housing section are welded together through vibration welding; and an attachment member that is attached to the second housing section, and that is provided extending across the first housing section and the second housing section on a side surface of the housing that intersects with a predetermined vibration direction of a vibration that is applied to at least one of the first housing section and the second housing section during the vibration welding; wherein a length from a first side surface of the first housing section up to a first opposite-side side surface that is on the opposite side from the first side surface is shorter than a length from a second side surface of the second housing section up to a second opposite-side side surface that is on the opposite side from the second side surface, the first side surface and the second side surface being a portion of the side surface on which the attachment member is provided; wherein a difference between the length from the first side surface up to the first opposite-side side surface and the length from the second side surface up to the second opposite-side side surface is larger than an amplitude value of the vibration that is applied to at least one of the first housing section and the second housing section during the vibration welding; wherein either one of the first housing section and the second housing section is provided with a protrusion, and the other is provided with a recess; wherein the protrusion and the recess are welded together through vibration welding in a state where the protrusion is fitted into the recess; wherein the first housing section includes: a vibration-direction protrusion arranged in the vibration direction, and a perpendicular-direction protrusion arranged in a direction that is perpendicular to the vibration direction;

wherein the second housing section includes: a vibration-direction recess arranged in the vibration direction, and a perpendicular-direction recess arranged in the direction perpendicular to the vibration direction; wherein the vibration-direction protrusion and the vibration-direction recess are welded together through vibration welding in a state where the vibration-direction protrusion is fitted into the vibration-direction recess; wherein the perpendicular-direction protrusion and the perpendicular-direction recess are welded together through vibration welding in a state where the perpendicular-direction protrusion is fitted into the perpendicular-direction recess; wherein the difference between the length from the first side surface up to the first opposite-side side surface and the length from the second side surface up to the second opposite-side side surface is larger than a difference between a distance, in the vibration direction, from an inner wall to an outer wall of the perpendicular-direction recess and a thickness of the perpendicular-direction protrusion in the vibration direction; wherein the attachment member is in contact with the second side surface; wherein a normal direction of a side surface, of among side surfaces of the attachment member, that is closer to the housing is in a normal direction of the second side surface; wherein the vibration direction is in a longitudinal direction of the developer containing device; wherein the developer containing device is provided with a developer bearing body for bearing the developer, and is a developing device that develops a latent image borne on an image bearing body using the developer borne on the developer bearing body; wherein the developer bearing body has a rotation shaft; and wherein the attachment member is a shaft-receiving member for receiving the rotation shaft.

In this way, the object of the present invention is achieved more advantageously because almost all of the effects described above can be obtained.

It is also possible to achieve an image forming apparatus comprising: a developer containing device that is provided with: a housing that includes a first housing section and a second housing section and that is configured to contain a developer, wherein the first housing section and the second housing section are welded together through vibration welding; and an attachment member that is attached to the second housing section, and that is provided extending across the first housing section and the second housing section on a side surface of the housing that intersects with a predetermined vibration direction of a vibration that is applied to at least one of the first housing section and the second housing section during the vibration welding; wherein a length from a first side surface of the first housing section up to a first opposite-side side surface that is on the opposite side from the first side surface is shorter than a length from a second side surface of the second housing section up to a second opposite-side side surface that is on the opposite side from the second side surface, the first side surface and the second side surface being a portion of the side surface on which the attachment member is provided.

With this image forming apparatus, physical interference between the first housing section and the attachment member is appropriately prevented.

It is also possible to achieve an image forming system comprising: a computer; and an image forming apparatus that is configured to be connected to the computer and that includes a developer containing device provided with: a housing that includes a first housing section and a second housing section and that is configured to contain a developer, wherein the first housing section and the second housing section are welded together through vibration welding; and an attachment member that is attached to the second housing section, and that is provided extending across the first housing section and the second housing section on a side surface of the housing that intersects with a predetermined vibration direction of a vibration that is applied to at least one of the first housing section and the second housing section during the vibration welding; wherein a length from a first side surface of the first housing section up to a first opposite-side side surface that is on the opposite side from the first side surface is shorter than a length from a second side surface of the second housing section up to a second opposite-side side surface that is on the opposite side from the second side surface, the first side surface and the second side surface being a portion of the side surface on which the attachment member is provided.

With this image forming system, physical interference between the first housing section and the attachment member is appropriately prevented.

OVERALL CONFIGURATION EXAMPLE OF IMAGE FORMING APPARATUS

Next, with reference to FIG. 1, an outline of an image forming apparatus will be described, taking a laser-beam printer 10 (hereinafter referred to also as "printer") as an example. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

As shown in FIG. 1, the printer 10 according to the present embodiment is provided with a charging unit 30, an exposing unit 40, a YMCK developing unit 50, a first transferring unit 60, an intermediate transferring body 70, and a cleaning unit 75 which serves as an example of a removed-developer containing device. These components are arranged in the direction of rotation of a photoconductor 20, which serves as an example of an image bearing body. The printer 10 is further provided with a second transferring unit 80, the fusing unit 90, a displaying unit 95 constructed of a liquid-crystal panel and serving as means for making notifications to a user, and a control unit 100 for controlling these units and managing the operations of the printer 10.

The photoconductor 20 has a cylindrical electrically-conductive base and a photoconductive layer formed on the outer peripheral surface of the electrically-conductive base, and it is rotatable about its central axis. In the present embodiment, the photoconductor 20 rotates clockwise, as shown by the arrow in FIG. 1.

The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image signals having been input from a not-shown host computer such as a personal computer or a word processor.

The YMCK developing unit is a device for developing the latent image formed on the photoconductor 20 using toner, that is, black (K) toner contained in a black developing device 51, magenta (M) toner contained in a magenta developing device 52, cyan (C) toner contained in a cyan developing device 53, and yellow (Y) toner contained in a yellow developing device 54. The toner is an example of developer contained in each of the developing devices 51, 52, 53 and 54.

The YMCK developing unit 50 can move the positions of the four developing devices 51, 52, 53, and 54 by rotating while the developing devices 51, 52, 53, and 54 are in an attached state. More specifically, the YMCK developing unit 50 holds the four developing devices 51, 52, 53, and 54 with four holding sections 55*a*, 55*b*, 55*c*, and 55*d*. The four developing devices 51, 52, 53, and 54 can be rotated about a rotation shaft 50*a* while maintaining their relative positions. Every time an image forming process for one page is finished, each of the developing devices 51, 52, 53 and 54 selectively opposes the photoconductor 20 to successively develop the latent image formed on the photoconductor 20 using the toner contained in each of the developing devices 51, 52, 53, and 54. It should be noted that each of the four developing devices 51, 52, 53, and 54 described above is attachable to and detachable from the respective holding sections 55*a*, 55*b*, 55*c* and 55*d* of the YMCK developing unit 50. Further, details on the developing devices 51, 52, 53 and 54 will be described further below.

The first transferring unit 60 is a device for transferring, onto the intermediate transferring body 70, a single-color toner image formed on the photoconductor 20. When the toners of all four colors are successively transferred in a superimposing manner, a full-color toner image will be formed on the intermediate transferring body 70.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the single-color toner image or the full-color toner image formed on the intermediate transferring body 70 onto a medium such as paper, film, and cloth.

The fusing unit 90 is a device for fusing the single-color toner image or the full-color toner image, which has been transferred onto the medium, to the medium to make it into a permanent image.

The cleaning unit 75 is a device that is provided between the first transferring unit 60 and the charging unit 30, that has a rubber cleaning blade 76 serving as an example of a developer-removing member and made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 2:
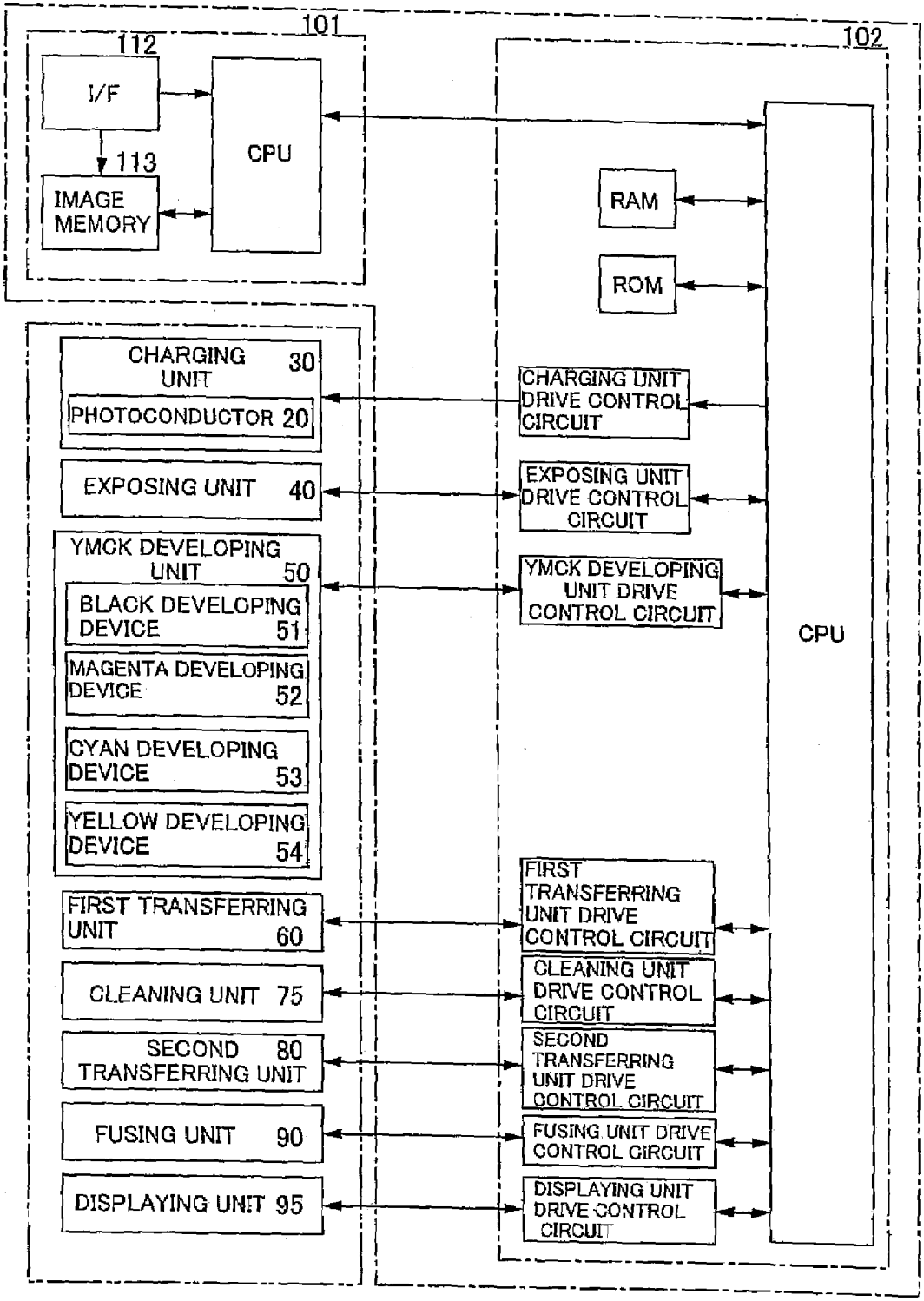
FIG. 2 is a block diagram showing a control unit of the printer of FIG. 1.

The control unit 100 is provided with a main controller 101 and a unit controller 102 as shown in FIG. 2. Image signals and control signals are input to the main controller 101, and according to instructions based on the image signals and control signals, the unit controller 102 controls each of the above-mentioned units to form an image.

Next, operations of the printer 10 structured as above will be described.

First, when image signals and control signals are input from the not-shown host computer to the main controller 101 of the printer 10 through an interface (I/F) 112, the photoconductor 20, a developing roller as an example of a developer bearing body, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing unit 50 positions the yellow developing device 54, which contains yellow (Y) toner, in the developing position, which is in opposition to the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner has been charged, is applied to the first transferring unit 60. It should be noted that, during this process, the photoconductor 20 and the intermediate transferring body 70 are placed in contact with each other, but the second transferring unit 80 is kept separated from the intermediate transferring body 70.

By subsequently performing the above-mentioned processes for the second, the third, and the fourth colors using each of the developing devices 51, 52, 53 and 54 toner images in four colors corresponding to the respective image signals are transferred onto the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via paper-feed roller 94 and resisting rollers 96. During transferring operations, a second transferring voltage is applied to the second transferring unit 80 and also the second transferring unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner adhering to the surface of the photoconductor 20 is scraped off by the cleaning blade 76 that is supported on the cleaning unit 75, and the photoconductor 20 is prepared for electrical charging for forming the next latent image. The scraped-off toner is collected in a remaining-toner collector of the cleaning unit 75.

<<<Overview of Control Unit>>>

Next, a configuration of the control unit 100 is described with reference to FIG. 2. The main controller 101 of the control unit 100 is connected to a host computer via the interface 112, and is provided with an image memory 113 for storing the image signals that have been input from the host computer. The unit controller 102 is electrically connected to the units in the body of the apparatus (i.e., the charging unit 30, the exposing unit 40, the YMCK developing unit 50, the first transferring unit 60, the cleaning unit 75, the second transferring unit 80, the fusing unit 90, and the displaying unit 95), and it detects the state of the units by receiving signals from sensors provided in those units, and controls them based on the signals that are input from the main controller 101.

FIRST EMBODIMENT

(1) CONFIGURATION EXAMPLE OF DEVELOPING DEVICE

Figure 3:
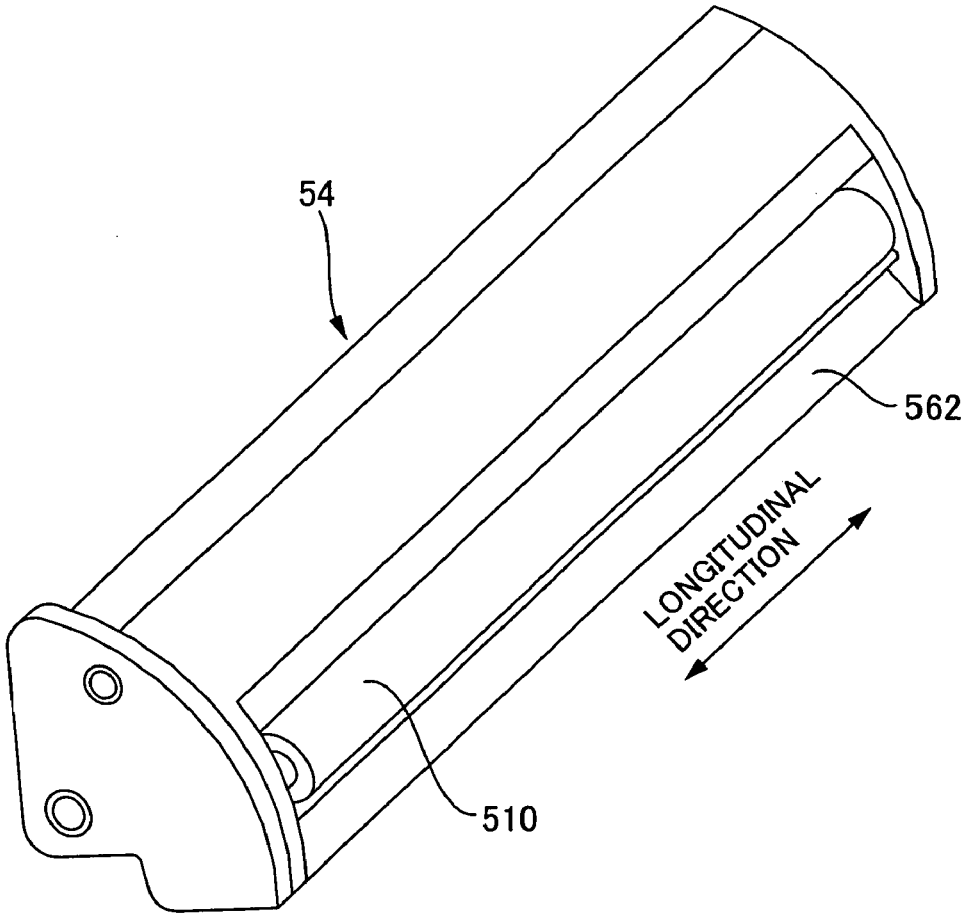
FIG. 3 is a conceptual diagram of a developing device.
Figure 4:
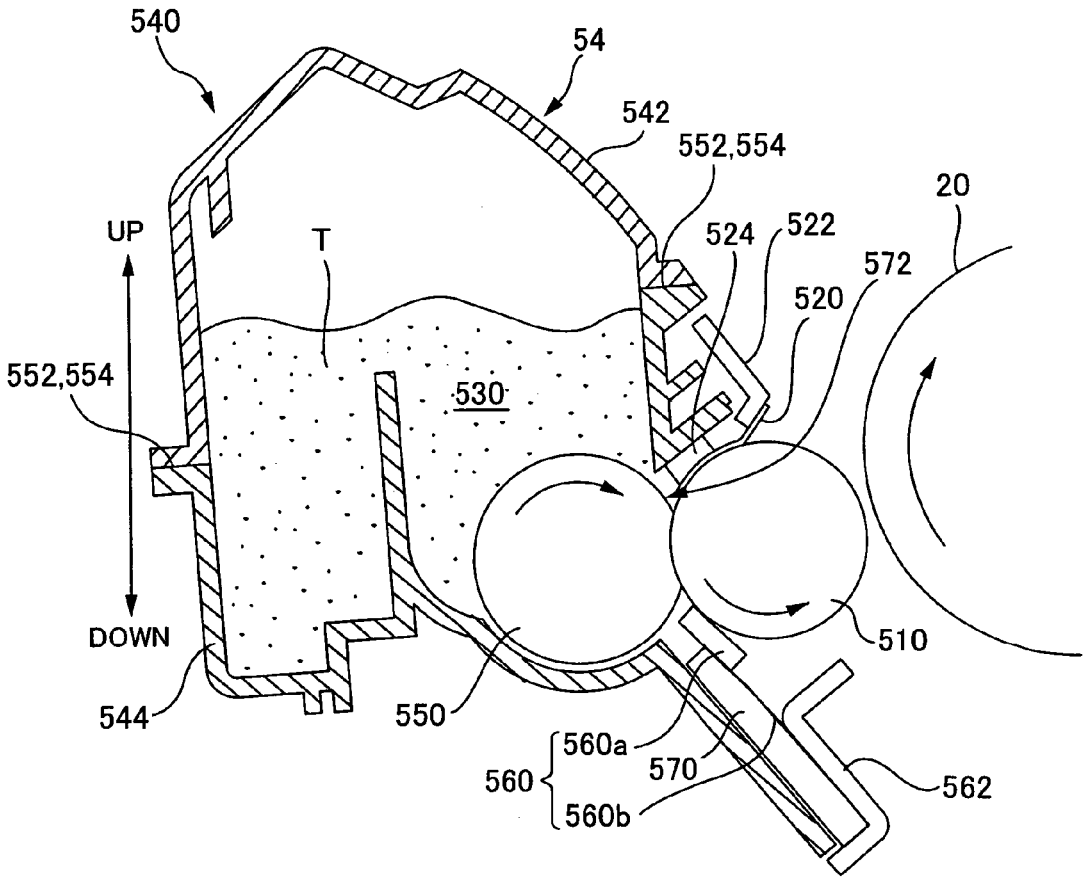
FIG. 4 is a section view showing main structural components of the developing device.

Next, with reference to FIG. 3 and FIG. 4, a first embodiment of a configuration of the developing device, which serves as an example of a developer containing device, will be described. It should be noted that the configuration of the overall image forming apparatus and the configuration of the control unit are the same for both the present first embodiment and the second embodiment described later on. FIG. 3 is a conceptual diagram of a developing device. FIG. 4 is a section view showing main structural components of the developing device. It should be noted that the section view shown in FIG. 4 is a section of the developing device bisected by a plane perpendicular to the longitudinal direction shown in FIG. 3. Further, in FIG. 4, the arrow indicates the vertical direction as in FIG. 1, and, for example, the central axis of a developing roller 510 is located below the central axis of the photoconductor 20. Further, in FIG. 4, the yellow developing device 54 is shown positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices 51, 52, 53 and 54 is the same, description will be made only about the yellow developing device 54 below.

The yellow developing device 54 has, for example, the developing roller 510, an upper sealing member 520, a toner containing section 530, a housing 540, a toner supplying roller 550, and a restriction blade 560.

The developing roller 510 bears toner T and delivers it to the developing position opposing the photoconductor 20. The developing roller 510 is made of, for example, aluminum alloy such as aluminum alloy 5056 or aluminum alloy 6063, or iron alloy such as STKM, and where necessary, the developing roller 510 is plated with, for example, nickel plating or chromium plating.

Further, the developing roller 510 is rotatable about its central axis. As shown in FIG. 4, the developing roller 510 rotates in the opposite direction (counterclockwise in FIG. 4) from the rotating direction of the photoconductor 20 (clockwise in FIG. 4). The central axis of the developing roller 510 is located below the central axis of the photoconductor 20. Further, as shown in FIG. 4, a gap exists between the developing roller 510 and the photoconductor 20 when the yellow developing device 54 comes into opposition to the photoconductor 20. That is, the yellow developing device 54 develops the latent image formed on the photoconductor 20 in a non-contacting state. It should be noted that an alternating field is generated between the developing roller 510 and the photoconductor 20 upon development of the latent image formed on the photoconductor 20.

The upper sealing member 520 prevents the toner T in the yellow developing device 54 from spilling out therefrom, and also collects the toner T, which is on the developing roller 510 that has passed the developing position, into the developing device 54 without scraping it off. The upper sealing member 520 is a seal made of, for example, polyethylene film. The upper sealing member 520 is supported by an upper seal-supporting metal plate 522, and is attached to the housing 540 via the upper seal-supporting metal plate 522.

An upper seal-urging member 524 made of, for example, Moltoprene is provided on one side of the upper sealing member 520 opposite from the side of the developing roller 510. The upper sealing member 520 is pressed against the developing roller 510 by the elastic force of the upper seal-urging member 524. It should be noted that the abutting position at which the upper sealing member 520 abuts against the developing roller 510 is located above the central axis of the developing roller 510.

The housing 540 is manufactured by welding together a plurality of integrally-molded housing sections, that is, an upper housing section 542, which serves as an example of a first housing section, and a lower housing section 544, which serves as an example of a second housing section. As shown in FIG. 4, the housing 540 has an opening 572 in its lower section, and the developing roller 510 is arranged in the opening 572 in such a state that a portion of the developing roller 510 is exposed to the outside.

Further, the housing 540 forms the toner containing section 530 capable of containing the toner T. It is possible to provide a stirring member in the toner containing section 530 for stirring the toner T. In the present embodiment, however, no stirring member is provided in the toner containing section 530 because the developing devices (the black developing device 51, the magenta developing device 52, the cyan developing device 53, and the yellow developing device 54) are rotated in conjunction with the rotation of the YMCK developing unit 50, and the toner T inside these developing devices 51, 52, 53, and 54 is stirred accordingly. It should be noted that the housing 540 will be described in more detail further below.

The toner supplying roller 550 is provided in the toner containing section 530, and supplies the toner T contained in the toner containing section 530 to the developing roller 510 and also strips off the toner T remaining on the developing roller 510 therefrom after development. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 is rotatable about its central axis. The central axis of the toner supplying roller 550 is located below the central axis of rotation of the developing roller 510. Further, the toner supplying roller .550 rotates in the opposite direction (clockwise in FIG. 4) from the rotating direction of the developing roller 510 (counterclockwise in FIG. 4).

The restriction blade 560 gives an electric charge to the toner T borne by the developing roller 510 as well as restricts the thickness of the layer of the toner T borne by the developing roller 510. The restriction blade 560 includes a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic. The rubber section 560*a* is supported by the rubber-supporting section 560*b*, and the rubber-supporting section 560*b* is mounted to the housing 540 via a blade-supporting metal plate 562 in a state that one end of the rubber-supporting section 560*b* is supported by the blade-supporting metal plate 562. Further, a blade-backing member 570 (see FIG. 4) made of, for example, Moltoprene is provided on one side of the restriction blade 560 opposite from the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 more evenly.

The end of the restriction blade 560 opposite from the end that is being supported by the blade-supporting metal plate 562, i.e., the tip end of the restriction blade 560, is not placed in contact with the developing roller 510; rather, a section at a predetermined distance from the tip end contacts, with some breadth, the developing roller 510. That is, the restriction blade 560 does not abut against the developing roller 510 at its edge, but abuts against the developing roller 510 near its central portion. Further, the restriction blade 560 is arranged so that its tip end faces towards the upstream side of the rotating direction of the developing roller 510, and thus, makes a so-called counter-abutment with respect to the developing roller 510. It should be noted that the abutting position at which the restriction blade 560 abuts against the developing roller 510 is below the central axis of the developing roller 510 and is also below the central axis of the toner supplying roller 550.

In the yellow developing device 54 structured as above, the toner supplying roller 550 supplies the toner T contained in the toner containing sections 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510 that has been charged and whose layer thickness has been restricted reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the upper sealing member 520 and is collected into the developing device 54 by the upper sealing member 520 without being scraped off. Then, the toner T that still remains on the developing roller 510 can be stripped off by the toner supplying roller 550.

===(1) Welding Structure and Welding Method of the Housing 540 ===

Figure 5:
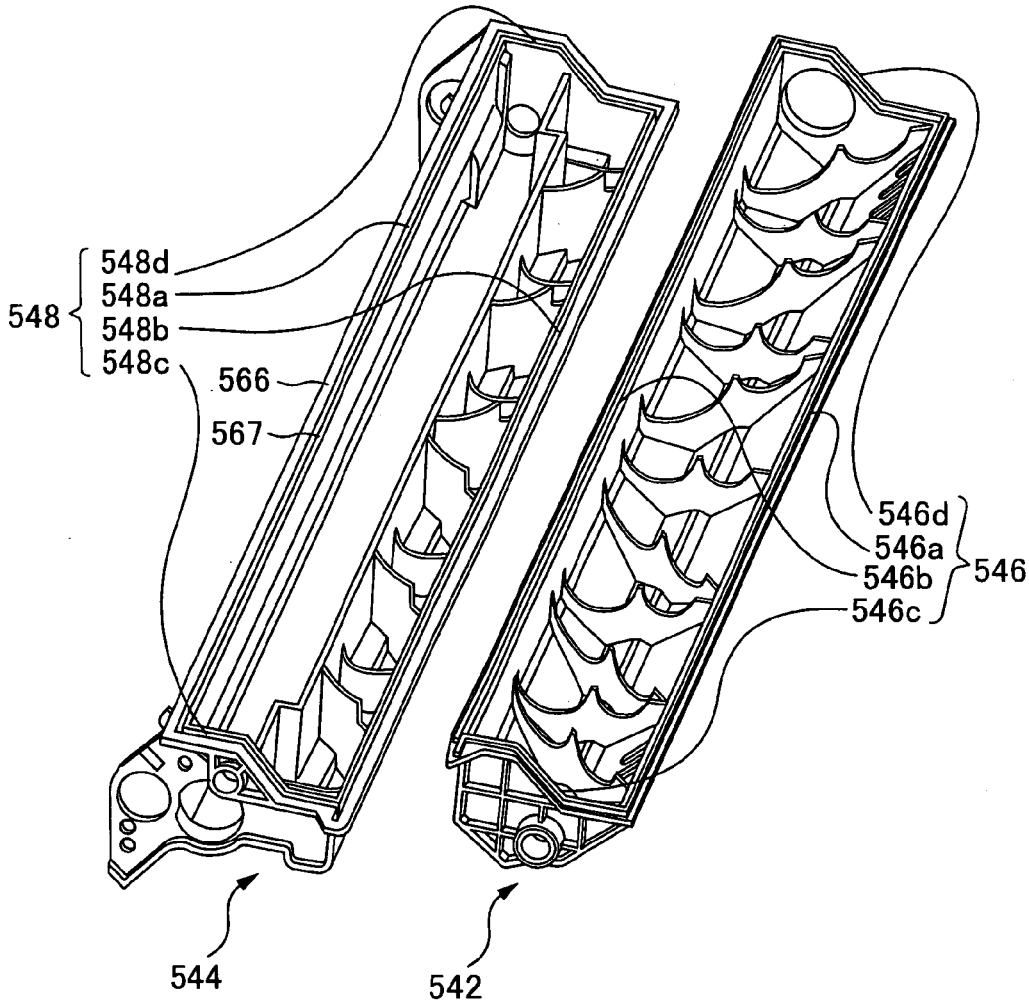
FIG. 5 is an overall perspective view of an upper housing section and a lower housing section before they are welded together according to a first embodiment.
Figure 6:
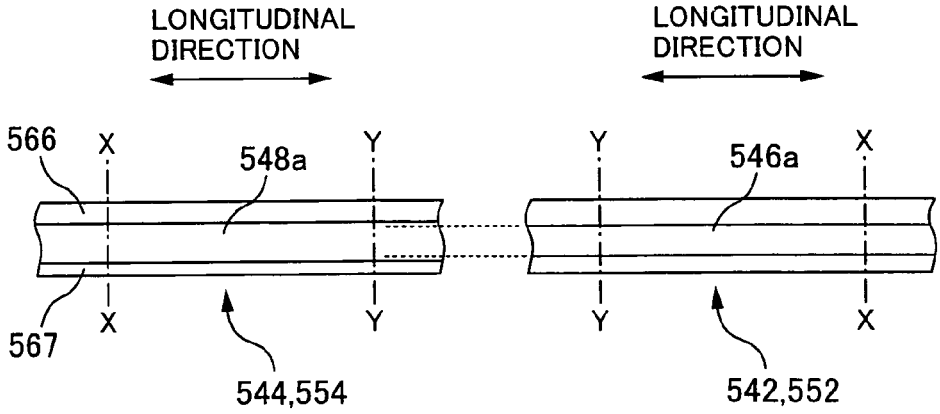
FIG. 6 is a diagram schematically showing a portion of the surface of a first longitudinal protrusion and a first longitudinal recess according to the first embodiment.
Figure 7:
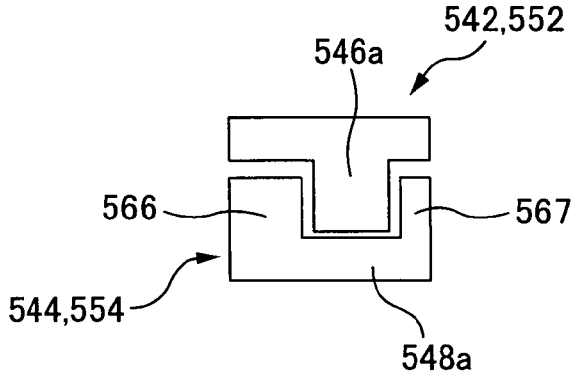
FIG. 7 is a section view schematically showing how the upper housing section and the lower housing section are placed on top of one another according to the first embodiment.
Figure 8:
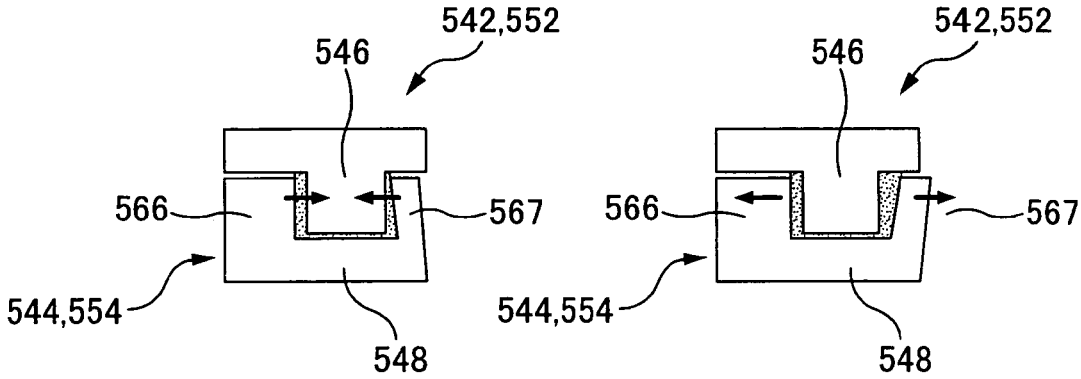
FIG. 8 is a schematic diagram showing a state of a protrusion and a recess when the amount of melt produced during vibration welding is large, and a state of the protrusion and the recess when the amount of melt is small according to the first embodiment.

Next, with reference to FIG. 4 through FIG. 8, the welding structure and the welding method of the housing 540 are described. FIG. 5 is an overall perspective view of the upper housing section 542 and the lower housing section 544 before they are welded together. FIG. 6 is a diagram schematically showing a portion of the surface of a first longitudinal protrusion 546*a* and a first longitudinal recess 548*a*. FIG. 7 is a section view schematically showing how the upper housing section 542 and the lower housing section 544 are placed on top of one another. FIG. 8 is a schematic diagram showing a state of the protrusion 546 and the recess 548 when the amount of melt produced during vibration welding is large, and a state of the protrusion 546 and the recess 548 when the amount of melt is small.

As described above, the housing 540 is formed by welding together a plurality of integrally-molded housing sections, that is, an upper housing section 542 and a lower housing section 544.

As shown in FIG. 5, a protrusion 546 is provided at a welding section 552 (see FIG. 4) of the upper housing section 542 where it is welded to the lower housing section 544, and a recess 548 is provided at a welding section 554 (see FIG. 4) of the lower housing section 544 where it is welded to the upper housing section 542. The protrusion 546 includes a first longitudinal protrusion 546*a* and a second longitudinal protrusion 546*b* provided in the longitudinal direction of the yellow developing device 54, and a first lateral protrusion 546*c* and a second lateral protrusion 546*d* provided in a direction that is perpendicular to the longitudinal direction of the yellow developing device 54. Further, the recess 548 includes a first longitudinal recess 548*a* and a second longitudinal recess 548*b* provided in the longitudinal direction of the yellow developing device 54, and a first lateral recess 548*c* and a second lateral recess 548*d* provided in a direction that is perpendicular to the longitudinal direction of the yellow developing device 54. The housing 540 is formed by welding together the protrusion 546 and the recess 548, more specifically, the first longitudinal protrusion 546*a* and the first longitudinal recess 548*a*, the second longitudinal protrusion 546*b* and the second longitudinal recess 548*b*, the first lateral protrusion 546*c* and the first lateral recess 548*c*, and the second lateral protrusion 546*d* and the second lateral recess 548*d*.

Below, the structure of the protrusion 546 and the recess 548 is described in more detail with reference to FIG. 6 and FIG. 7. It should be noted that in the description below, attention is paid only to the first longitudinal protrusion 546*a* and the first longitudinal recess 548*a*, but the description applies in the same way to the other protrusions (i.e., the second longitudinal protrusion 546*b*, the first lateral protrusion 546*c*, and the second lateral protrusion 546*d*) and the other recesses (i.e., the second longitudinal recess 548*b*, the first lateral recess 548*c*, and the second lateral recess 548*d*).

FIG. 6 shows a portion of the surface of the first longitudinal protrusion 546*a* and the first longitudinal recess 548*a*. The first longitudinal protrusion 546*a* of the upper housing section 542 is shown in the diagram on the right, and the first longitudinal recess 548*a* of the lower housing section 544 is shown in the diagram on the left. The upper housing section 542 and the lower housing section 544 are placed on top of one another and welded such that the alternate long-and-short dashed lines indicated by X in the right-side diagram and the left-side diagram match one another, and that the alternate long-and-short dashed lines indicated by Y in the right-side diagram and the left-side diagram match one another.

FIG. 7 is a section view showing how the upper housing section 542 and the lower housing section 544 are placed on top of one another. This is a section view of the upper housing section 542 and the lower housing section 544, which have been superposed, taken along either the alternate long-and-short dashed line X or Y described above. As shown in the figure, the upper housing section 542 is superposed on the lower housing section 544 in such a state that the first longitudinal protrusion 546*a* is fitted into the first longitudinal recess 548*a*.

It should be noted that as shown in FIG. 6 and FIG. 7, the outer wall 566 of the first longitudinal recess 548*a* is thicker than its inner wall 567. Here, the inner wall 567 of the recess 548 is the wall closer to the toner containing section 530 described above, and the outer wall of the recess 548 is the wall 566 farther from the toner containing section 530.

The method of welding the housing 540 is described next. The upper housing section 542 and the lower housing section 544 are welded together in the state described above, that is, the state in which the upper housing section 542 and the lower housing section 544 are placed on top of one another. In the present embodiment, so-called "vibration welding" is adopted as the welding method. In vibration welding, the upper housing section 542 is fixed to and held by an upper jig and the lower housing section 544 is fixed to and held by a lower jig, and in a state where the upper and Lower housing sections 542 and 544 are pressed in contact with each other, the upper jig is vibrated by approximately 0.8 to 1.5 mm at a rate of 100 to 300 times per second in a direction along the longitudinal direction of the yellow developing device 54, that is, in the direction piercing through the paper face of FIG. 7. Due to this vibration, frictional heat is produced between the upper and lower housing sections 542 and 544. Due to this frictional heat, the protrusion 546 melts, and the protrusion 546 and the recess 548, that is, the upper housing section 542 and the lower housing section 544 are welded together. It should be noted that the melt, which is produced as a result of the protrusion 546 melting, is located in a gap between the protrusion 546 and the recess 548.

It should be noted that in the present embodiment, the predetermined vibration direction in which the upper housing section 542 is caused to vibrate during vibration welding is in the longitudinal direction of the yellow developing device 54, as described above. Therefore, the first longitudinal protrusion 546*a* and the second longitudinal protrusion 546*b* correspond to the "vibration-direction protrusions" which are arranged in the predetermined vibration direction of the vibration that is applied to the upper housing section 542 during vibration welding, and the first lateral protrusion 546*c* and the second lateral protrusion 546*d* correspond to the "perpendicular-direction protrusions" which are arranged in a direction perpendicular to the predetermined vibration direction. Similarly, the first longitudinal recess 548*a* and the second longitudinal recess 548*b* correspond to the "vibration-direction recesses" which are arranged in the predetermined vibration direction of the vibration that is applied to the upper housing section 542 during vibration welding, and the first lateral recess 548*c* and the second lateral recess 548*d* correspond to the "perpendicular-direction recesses" which are arranged in a direction perpendicular to the predetermined vibration direction.

As described above, in the present embodiment, the thickness of the outer wall 566 of the recess 548 provided in the lower housing section 544, which serves as the second housing section, is thicker than that of the inner wall 567 of the recess 548. In this way, it is possible to achieve a developer containing device, for example, in which deformation of the outer wall 566 of the recess 548 is prevented appropriately.

That is, as described in the "Description of the Related Art", so-called vibration welding is adopted as an effective method for welding the lower housing section 544 to the upper housing section 542. In vibration welding, the upper housing section 542 and the lower housing section 544 are each fixed to and held by different jigs, and in a state where both housing sections are pressed in contact with one another, one of the jigs (the upper jig in the present embodiment) is vibrated in a predetermined vibration direction. Due to this vibration, frictional heat is produced between the housing sections, and due to this frictional heat, the protrusion 546 melts, and the protrusion 546 and the recess 548, that is, the upper housing section 542 and the lower housing section 544 are welded together. The melt, which is produced as a result of the protrusion 546 eta melting, is located in a gap between the protrusion 546 and the recess 548.

Further, in the present embodiment, the lower housing section 544 is structured such that the outer wall 566 of the recess 548 provided in the lower housing section 544 is thicker than the inner wall 567 of that recess 548.

Therefore, if there is a variation in the amount of melt that is produced during vibration welding and the amount of melt is large, then, as shown in the right diagram of FIG. 8, a force is generated in such a direction that the melt (the spotted section in the right diagram of FIG. 8) presses the walls (the outer wall 566 and the inner wall 567) that structure the recess 548 away from the protrusion 546 (in the direction shown by the arrow in the right diagram of FIG. 8). However, the thick outer wall 566 is prevented from deforming, and only the thin inner wall 567 collapses in the direction of the pressing force.

On the other hand, if the amount of melt is small, then as shown in the left figure of FIG. 8, a force is generated in such a direction that the melt (the spotted section in the left diagram of FIG. 8) pulls the walls (the outer wall 566 and the inner wall 567) that structure the recess 548 toward the protrusion 546 (in the direction shown by the arrow in the left diagram of FIG. 8). However, the thick outer wall 566 is prevented from deforming, and only the thin inner wall 567 collapses in the direction of the pulling force.

In this way, the outer wall 566, which should be prevented from deforming because it can be visually observed and also because other components may be fixed thereto, is appropriately prevented from deforming.

It should be noted that the thin inner wall 567 described above has the function of adjusting the capacity of the recess 548 that contains the melt. More specifically, even though there is a variation in the amount of melt that is produced during vibration welding as described above, the inner wall 567 deforms according to the amount of melt that has been produced, because it is thin, and as a result, the inner wall 567 serves as to adjust the capacity of the recess 548 which contains the melt.

The capacity-adjusting function of the inner wall 567 prevents the melt from spilling out from the recess 548 in case the amount of melt is large. Therefore, it is preferable to make the inner wall 567 thin so as to allow it to deform.

===(1) Other Considerations===

In the foregoing embodiment, the protrusion 546 was provided on the upper housing section 542 and the recess 548 was provided in the lower housing section 544, but instead, the recess 548 may be provided in the upper housing section 542 and the protrusion 546 may be provided on the lower housing section 544.

Further, in the foregoing embodiment, the upper jig, among the upper and the lower jigs, was caused to vibrate, but the lower jig may be vibrated instead.

Further, in the foregoing embodiment, the upper housing section 542 included: a first longitudinal protrusion 546*a* and a second longitudinal protrusion 546*b* as an example of a vibration-direction protrusion arranged in a predetermined vibration direction of a vibration that is applied to the upper housing section 542 during the vibration welding, and a first lateral protrusion 546*c* and a second lateral protrusion 546*d* as an example of a perpendicular-direction protrusion arranged in a direction that is perpendicular to the predetermined vibration direction; the lower housing section 544 included: a first longitudinal recess 548*a* and a second longitudinal recess 548*b* as an example of a vibration-direction recess arranged in the predetermined vibration direction, and a first lateral recess 548*c* and a second lateral recess 548*d* as an example of a perpendicular-direction recess arranged in the direction perpendicular to the predetermined vibration direction; the vibration-direction protrusion and the vibration-direction recess were welded together through vibration welding in a state where the vibration-direction protrusion is fitted into the vibration-direction recess; the perpendicular-direction protrusion and the perpendicular-direction recess were welded together through vibration welding in a state where the perpendicular-direction protrusion is fitted into the perpendicular-direction recess; and an outer wall 566 of at least one (in the foregoing embodiment, both) of the vibration-direction recess and the perpendicular-direction recess was thicker than an inner wall 567 of that recess. This, however, is not a limitation, and the protrusions and the recesses do not necessarily have to be arranged in the vibration direction of the vibration and the direction perpendicular thereto.

Further, in the foregoing embodiment, the outer wall 566 of both the vibration-direction recess and the perpendicular-direction recess was thicker than the inner wall 567 of those recesses, but the outer wall 566 of only the perpendicular-direction recess may be thicker than the inner wall 567 of the perpendicular-direction recess.

When comparing the welding between the vibration-direction protrusion and the vibration-direction recess and the welding between the perpendicular-direction protrusion and the perpendicular-direction recess, the protrusion of the perpendicular-direction protrusion and the perpendicular-direction recess is less prone to melting because they are not arranged in the predetermined vibration direction, and thus, a variation in the amount of melt is likely to occur. In view of this, by applying the present invention to the perpendicular-direction recess, the above-described effect, that is, the effect that deformation of the outer wall of the recess is appropriately prevented, is more advantageously achieved.

Further, in the foregoing embodiment, the predetermined vibration direction was in a longitudinal direction of the developing device. This, however, is not a limitation, and for example, the predetermined vibration direction may be in a lateral direction of the developing device.

The foregoing embodiment, however, is preferable in terms that vibration welding of the housing can be performed more conveniently and appropriately.

Further, in the foregoing embodiment, the developing device was attachable to and detachable from an image forming apparatus that forms an image using the toner T contained in the developing device. This, however, is not a limitation, and for example, the developing device does not have to be attachable/detachable.

However, in the case where the developing device is made attachable to and detachable from an image forming apparatus, the outer wall of the recess provided in the lower housing section is visually observed more often. Therefore, the above-described effect, that is, the effect that deformation of the outer wall of the recess is appropriately prevented, is more advantageously achieved. The foregoing embodiment is more effective from this standpoint.

Further, in the above, a developing device was described as an example of the developer containing device. This, however, is not a limitation, and the developer containing device may be any kind of device as long as it can contain a developer. For example, the present invention is applicable to a cleaning unit 75 that is provided with a cleaning blade 76 and that contains the toner T that has been removed by the cleaning blade 76.

SECOND EMBODIMENT

(2) CONFIGURATION EXAMPLE OF DEVELOPING DEVICE

Figure 9:
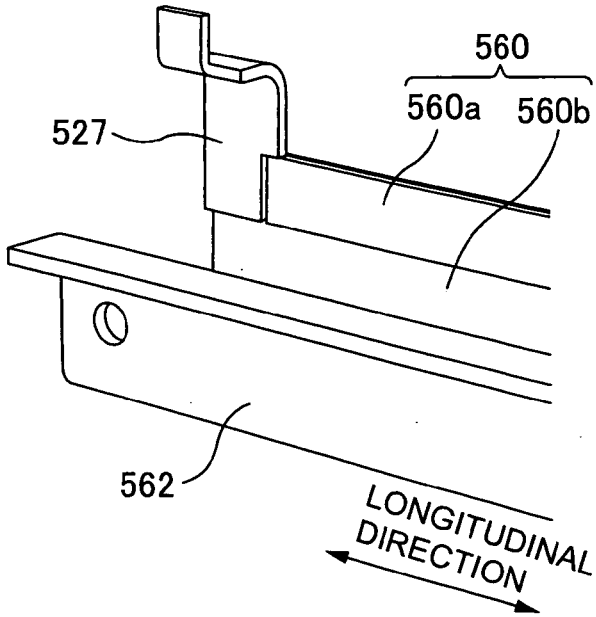
FIG. 9 is a perspective view showing the state in which a restriction blade provided with end seals is fixed to a blade-supporting metal plate according to a second embodiment.
Figure 10:
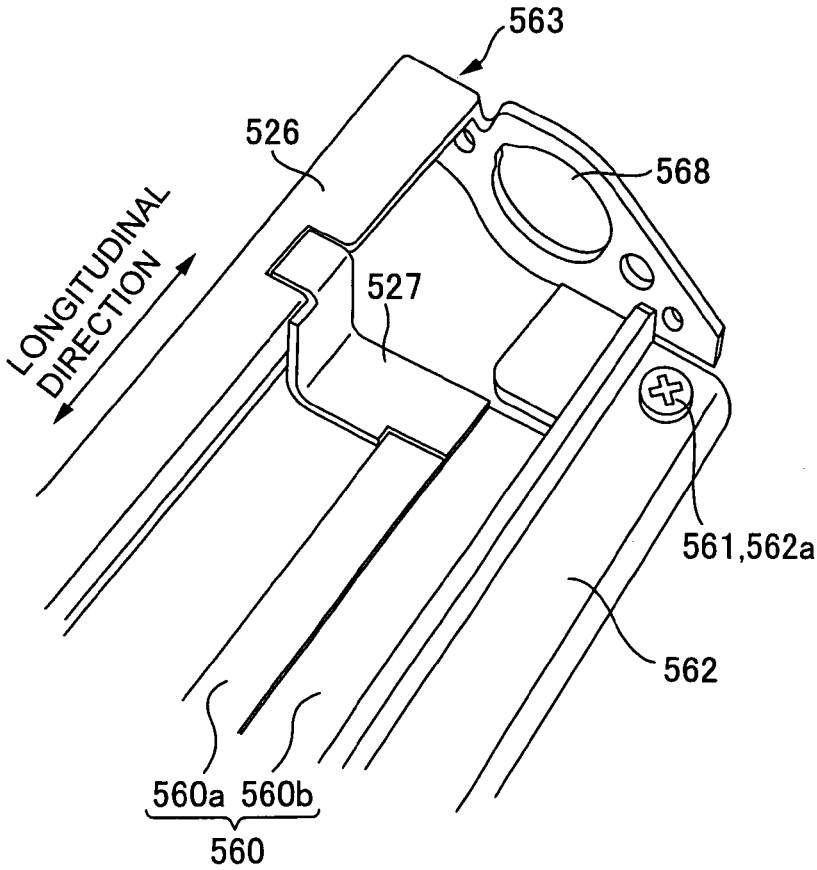
FIG. 10 is a perspective view showing a layer-thickness restriction unit according to the second embodiment.
Figure 11:
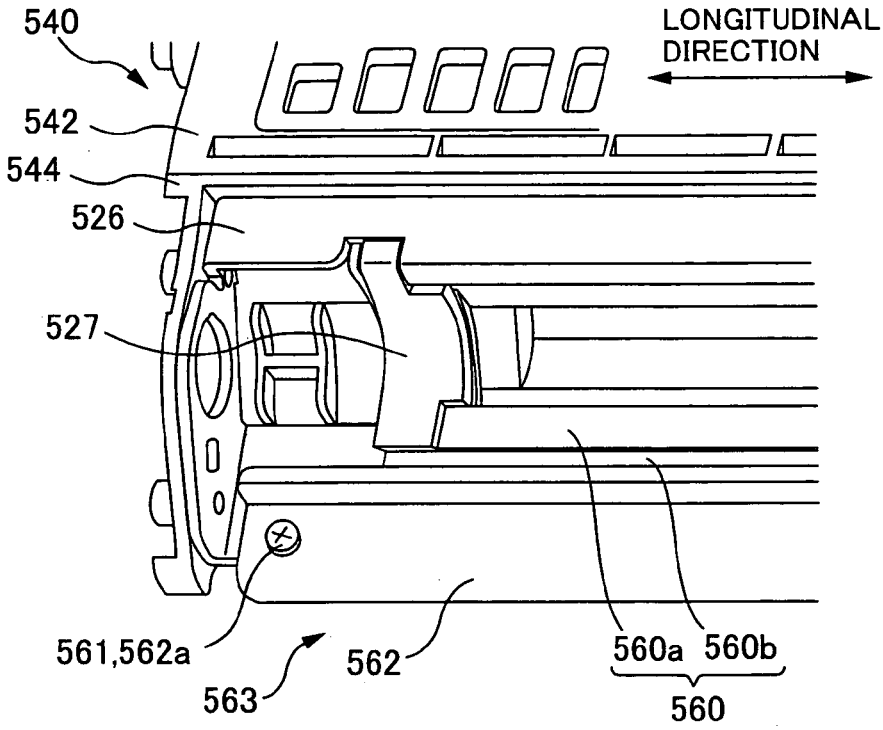
FIG. 11 is a perspective view showing the state in which the layer-thickness restriction unit is mounted to a housing according to the second embodiment.
Figure 12:
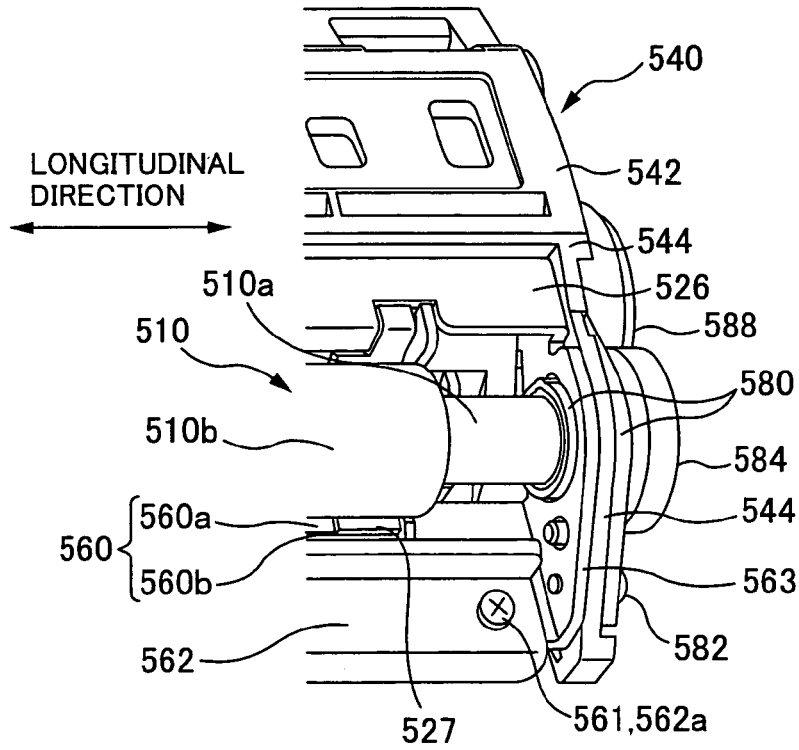
FIG. 12 is a perspective view showing the state in which a developing roller is supported by a shaft-receiving member according to the second embodiment.
Figure 13:
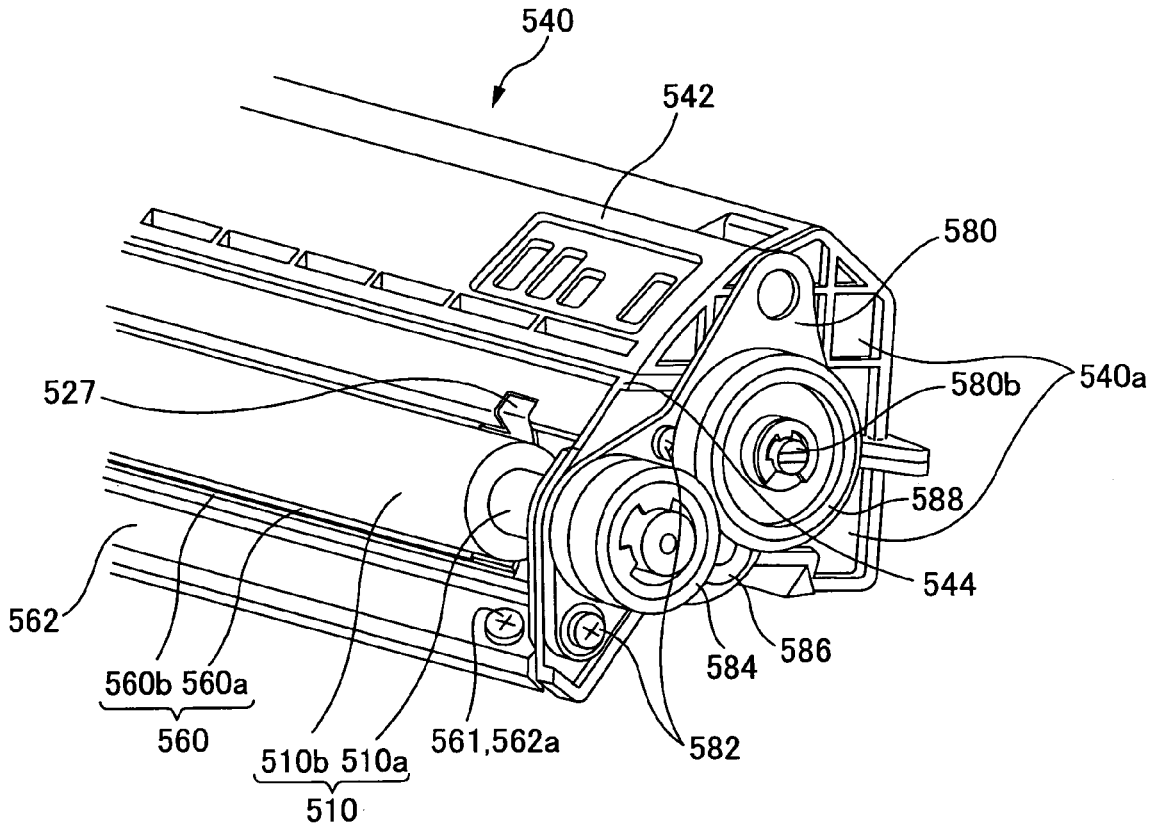
FIG. 13 is a perspective view showing the state in which the developing roller is supported by the shaft-receiving member according to the second embodiment.
Figure 14:
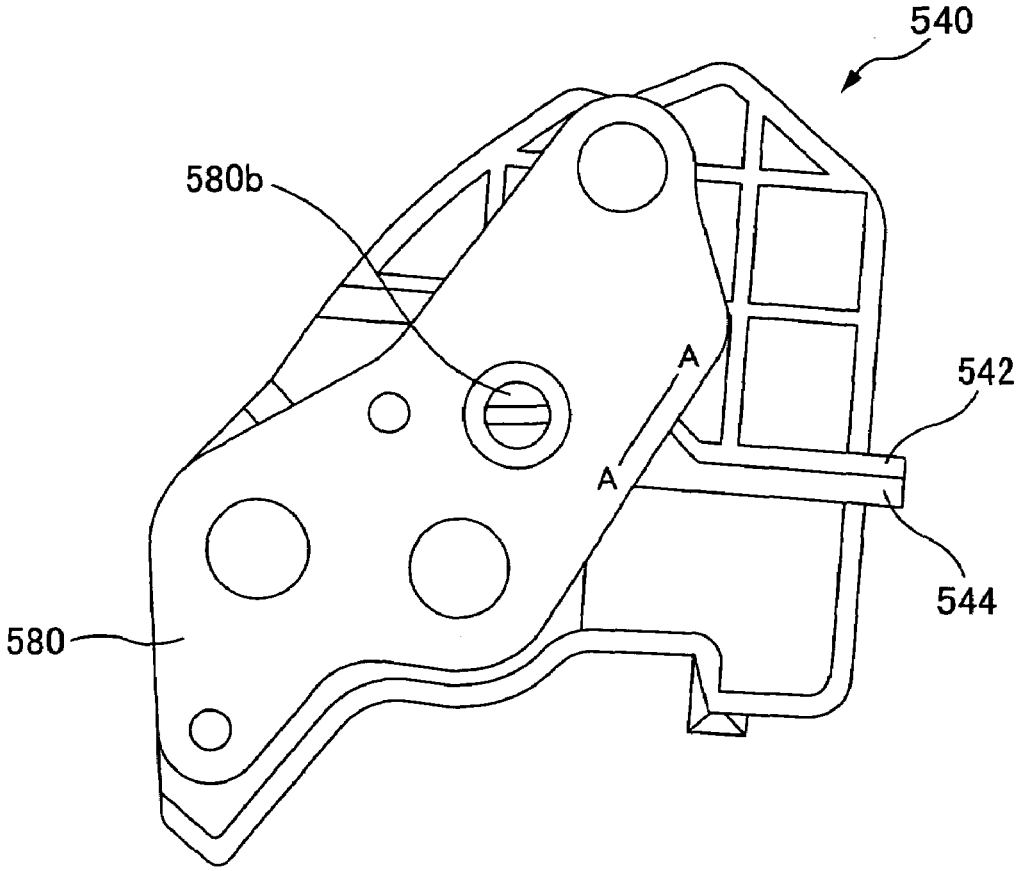
FIG. 14 is a side view showing the positional relationship between the housing and the shaft-receiving member according to the second embodiment.

Next, with reference to FIG. 3, FIG. 4, and FIG. 9 to FIG. 14, a second embodiment of a configuration of the developing device, which serves as an example of a developer containing device, will be described. It should be noted that the configuration of the overall image forming apparatus and the configuration of the control unit are the same for both the first embodiment described above and the present second embodiment. FIG. 3 and FIG. 4 have been described in the first embodiment. FIG. 9 is a perspective view showing the state in which the restriction blade 560 provided with the end seals 527 is fixed to the blade-supporting metal plate 562. FIG. 10 is a perspective view showing a layer-thickness restriction unit 563. FIG. 11 is a perspective view showing the state in which the layer-thickness restriction unit 563 is mounted to the housing 540. FIG. 12 and FIG. 13 are perspective views showing the state in which the developing roller 510 is supported by a shaft-receiving member 580. FIG. 14 is a side view showing the positional relationship between the housing 540 and the shaft-receiving member 580. It should be noted that the section view shown in FIG. 4 is a section of the developing device bisected by a plane perpendicular to the longitudinal direction shown in FIG. 3. Further, in FIG. 4, the arrow indicates the vertical direction as in FIG. 1, and, for example, the center of a rotation shaft 510*a* of the developing roller 510 is located below the central axis of the photoconductor 20. Further, in FIG. 4, the yellow developing device 54 is shown positioned at the developing position, which is in opposition to the photoconductor 20. Further, FIG. 9 through FIG. 11 only show one end in the longitudinal direction of the restriction blade 560, but the other end is configured in the same way.

The YMCK developing unit 50 is provided with: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices 51, 52, 53 and 54 is the same, description will be made only about the yellow developing device 54 below.

The yellow developing device 54 has, for example, the developing roller 510, an upper sealing member 520, a toner containing section 530, a housing 540, a toner supplying roller 550, and a restriction blade 560.

The developing roller 510 bears toner T and delivers it to the developing position opposing the photoconductor 20. The developing roller 510 is made of, for example, aluminum alloy such as aluminum alloy 5056 or aluminum alloy 6063, or iron alloy such as STKM, and where necessary, the developing roller 510 is plated with, for example, nickel plating or chromium plating.

The developing roller 510 of the present embodiment has a rotation shaft 510*a* and a large-diameter section 510*b*. The developing roller 510 is rotatably supported by the rotation shaft 510*a* being supported. As shown in FIG. 4, the developing roller 510 rotates in the opposite direction (counterclockwise in FIG. 4) from the rotating direction of the photoconductor 20 (clockwise in FIG. 4). The center of the rotation shaft 510*a* is located below the central axis of the photoconductor 20.

Further, a gap exists between the developing roller 510 and the photoconductor 20 when the yellow developing device 54 comes into opposition to the photoconductor 20. That is, the yellow developing device 54 develops the latent image formed on the photoconductor 20 in a non-contacting state. It should be noted that an alternating field is generated between the developing roller 510 and the photoconductor 20 upon development of the latent image formed on the photoconductor 20.

The upper sealing member 520 prevents the toner T in the yellow developing device 54 from spilling out therefrom, and also collects the toner T, which is on the developing roller 510 that has passed the developing position, into the developing device 54 without scraping it off. The upper sealing member 520 is a seal made of, for example, polyethylene film. The upper sealing member 520 is supported by an upper seal-supporting metal plate 522, and is attached to the housing 540 via the upper seal-supporting metal plate 522.

An upper seal-urging member 524 made of, for example, Moltoprene is provided on one side of the upper sealing member 520 opposite from the side of the developing roller 510. The upper sealing member 520 is pressed against the developing roller 510 by the elastic force of the upper seal-urging member 524. It should be noted that the abutting position at which the upper sealing member 520 abuts against the developing roller 510 is located above the center of the rotation shaft 510*a* of the developing roller 510. Further, the upper seal-supporting metal plate 522 configures a part of a frame 526 which is described further below.

The housing 540 is manufactured by welding together a plurality of integrally-molded housing sections, that is, an upper housing section 542, which serves as an example of a first housing section, and a lower housing section 544, which serves as an example of a second housing section. As shown in FIG. 4, the housing 540 has an opening 572 in its lower section, and the developing roller 510 is arranged in the opening 572 in such a state that a portion of the developing roller 510 is exposed to the outside.

Further, the housing 540 forms the toner containing section 530 capable of containing the toner T. It is possible to provide a stirring member in the toner containing section 530 for stirring the toner T. In the present embodiment, however, no stirring member is provided in the toner containing section 530 because the developing devices (the black developing device 51, the magenta developing device 52, the cyan developing device 53, and the yellow developing device 54) are rotated in conjunction with the rotation of the YMCK developing unit 50, and the toner T inside these developing devices 51, 52, 53 and 54 is stirred accordingly. It should be noted that the housing 540 will be described in more detail further below.

The toner supplying roller 550 is provided in the toner containing section 530, and supplies the toner T contained in the toner containing section 530 to the developing roller 510 and also strips off the toner T remaining on the developing roller 510 therefrom after development. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 is rotatable about its rotation shaft. The center of rotation shaft of the toner supplying roller 550 is located below the center of the rotation shaft 510*a* of the developing roller 510. Further, the toner supplying roller 550 rotates in the opposite direction (clockwise in FIG. 4) from the rotating direction of the developing roller 510 (counterclockwise in FIG. 4).

The restriction blade 560 gives an electric charge to the toner T borne by the developing roller 510 as well as restricts the thickness of the layer of the toner T borne by the developing roller 510. The restriction blade 560 includes a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic.

The rubber section 560*a* is supported by the rubber-supporting section 560*b*, and the rubber-supporting section 560*b* presses the rubber section 560*a* against the developing roller 510 with its urging force. The rubber-supporting section 560*b* is mounted to a blade-supporting metal plate 562 in a state where one end of the rubber-supporting section 560*b* is supported by the blade-supporting metal plate 562. The blade-supporting metal plate 562 is, for example, a steel plate having a zinc plating layer.

The other end of the restriction blade 560 that is not being supported by the blade-supporting metal plates 562, i.e., the tip end of the restriction blade 560, is not placed in contact with the developing roller 510; rather, a section at a predetermined distance from the tip end contacts, with some breadth, the developing roller 510. In other words, the restriction blade 560 does not abut against the developing roller 510 at its tip end, but abuts against the developing roller 510 near its central portion. Further, the restriction blade 560 is arranged so that its tip end faces towards the upstream side of the rotating direction of the developing roller 510, and thus, makes a so-called counter-abutment with respect to the developing roller 510. It should be noted that the abutting position at which the restriction blade 560 abuts against the developing roller 510 is situated below the center of the rotation shaft 510*a* of the developing roller 510 and also below the center of the rotation shaft of the toner-supplying roller 550.

Further, a blade-backing member 570 (see FIG. 4) made of, for example, Moltoprene is provided on one side of the restriction blade 560 opposite from the side of the developing roller 510. The blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 more evenly.

Further, end seals 527 (see FIG. 9) are provided on the outer sides, in the longitudinal direction, of the rubber section 560*a* of the restriction blade 560. The end seals 527 are made of nonwoven fabric, and function as to prevent the toner T from spilling from between the housing 540 and the circumferential surface of the developing roller 510 at both ends, in the axial direction, of the developing roller 510.

As shown in FIG. 10, the blade-supporting metal plate 562 has, in both ends in the longitudinal direction, screw holes 562*a* for fixing the blade-supporting metal plate 562 to the developing device 54. The blade-supporting metal plate 562 is fixed at both ends in the longitudinal direction thereof to the frame 526 with screws 561. It should be noted that in the present embodiment, the unit shown in FIG. 10, in which the restriction blade 560, the blade-supporting metal plate 562 to which the restriction blade 560 is fixed, and the frame 526 are made into a unit, is referred to as the "layer-thickness restriction unit 563".

As shown in FIG. 11, the layer-thickness restriction unit 563 is mounted to the housing 540 described above. Further, as shown in FIG. 12, the layer-thickness restriction unit 563 is positioned by a shaft-receiving member 580, which serves as an example of an attachment member for receiving the rotation shaft 510*a* of the developing roller 510. The rotation shaft 510*a* of the developing roller 510 is su ported, in a state where it passes through a developing-roller through hole 568 (see FIG. 10) and a hole provided in the housing 540, by the shaft-receiving member 580 which is arranged more to the outside than the developing-roller through hole 568. In such a state, the rubber section 560*a* and the end seals 527 abut against the surface of the developing roller 510 and achieve their respective functions described above.

As shown in FIG. 13 and FIG. 14, the shaft-receiving member 580 is attached to the lower housing section 544, and is provided on a side surface 540*a* of the housing 540 in a manner extending across the upper housing section 542 and the lower housing section 544. The side surface 540*a* of the housing 540 includes: a portion in which the shaft-receiving member 580 is not provided; a portion in which the shaft-receiving member 580 is provided and that is on the side of the upper housing section 542 (this portion is referred to as "first side surface 542*a*"; see FIG. 18); and a portion in which the shaft-receiving member 580 is provided and that is on the side of the lower housing section 544 (this portion is referred to as "second side surface 544*a*"; see FIG. 18). The shaft-receiving member 580 is fixed to the lower housing section 544 with screws 582 in a state where the shaft-receiving member 580 is in contact with the second side surface 544*a*. Further, the normal direction of a side surface 580*a* (see FIG. 18), of among the side surfaces of the shaft-receiving member 580, that is closer to the housing 540 is in the normal direction of the second side surface 544*a*.

It should be noted that the shaft-receiving member 580 also has the function of receiving the rotation shaft of the toner supplying roller 550 described above. Further, a developing-roller gear 584 for rotating the developing roller 510 is provided at an end of the rotation shaft 510*a* of the developing roller 510, and a toner-supplying-roller gear 586 for rotating the toner supplying roller 550 is provided at an end of the rotation shaft of the toner supplying roller 550. Through an intermediate gear 588 provided on a gear-supporting section 580*b* of the shaft-receiving member 580, a drive force from a not-shown driving source is transmitted to the developing-roller gear 584 and the toner-supplying-roller gear 586.

In the yellow developing device 54 structured as above, the toner supplying roller 550 supplies the toner T contained in the toner containing sections 530 to the developing roller 510. With the rotation of the developing roller 510, the toner T, which has been supplied to the developing roller 510, reaches the abutting position of the restriction blade 560; then, as the toner T passes the abutting position, the toner T is electrically charged and its layer thickness is restricted. With further rotation of the developing roller 510, the toner T on the developing roller 510 that has been charged and whose layer thickness has been restricted reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the upper sealing member 520 and is collected into the developing device 54 by the upper sealing member 520 without being scraped off. Then, the toner T that still remains on the developing roller 510 can be stripped off by the toner supplying roller 550.

===(2) Welding Structure and Welding Method of the Housing 540===

Figure 15:
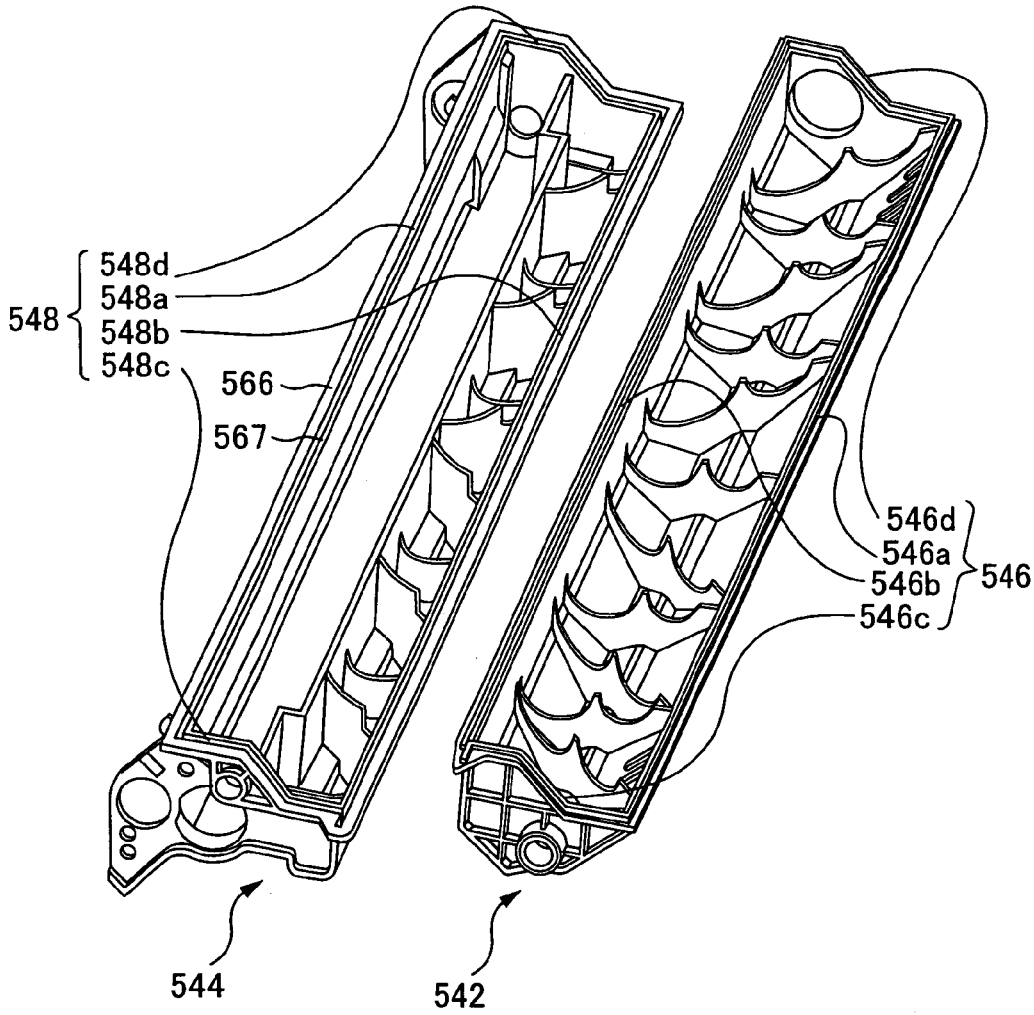
FIG. 15 is an overall perspective view of the upper housing section and the lower housing section before they are welded together according to the second embodiment.
Figure 16:
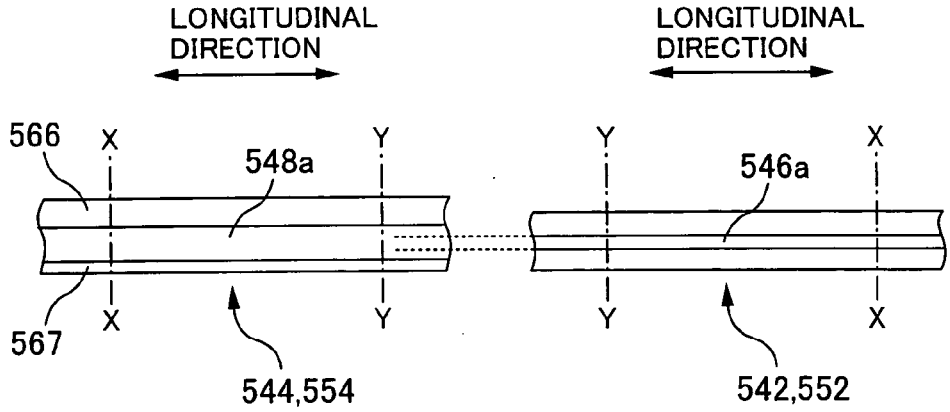
FIG. 16 is a diagram schematically showing a portion of the surface of a first longitudinal protrusion and a first longitudinal recess according to the second embodiment.
Figure 17:
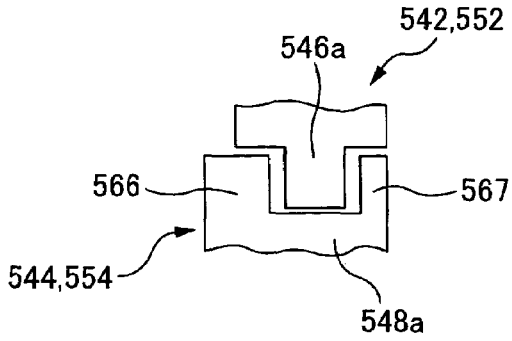
FIG. 17 is a section view schematically showing how the upper housing section and the lower housing section are placed on top of one another according to the second embodiment.
Figure 18:
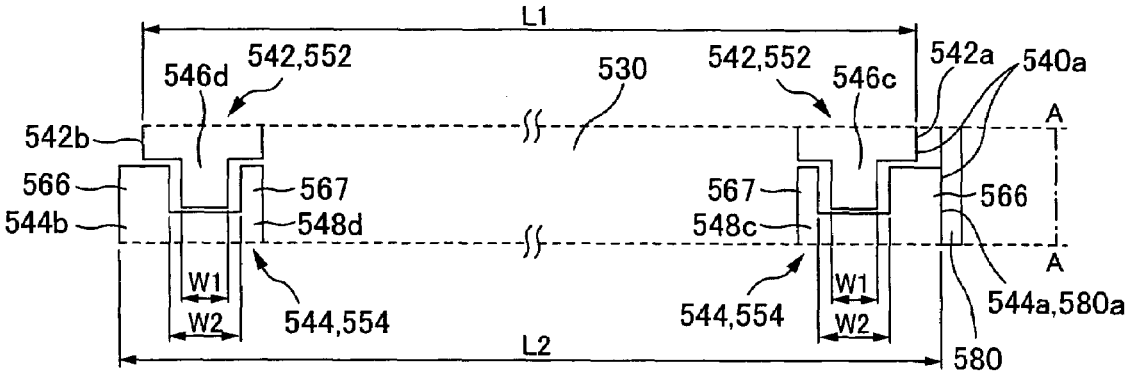
FIG. 18 is a schematic diagram showing a section view taken along line A-A of FIG. 14 according to the second embodiment.
Figure 19:
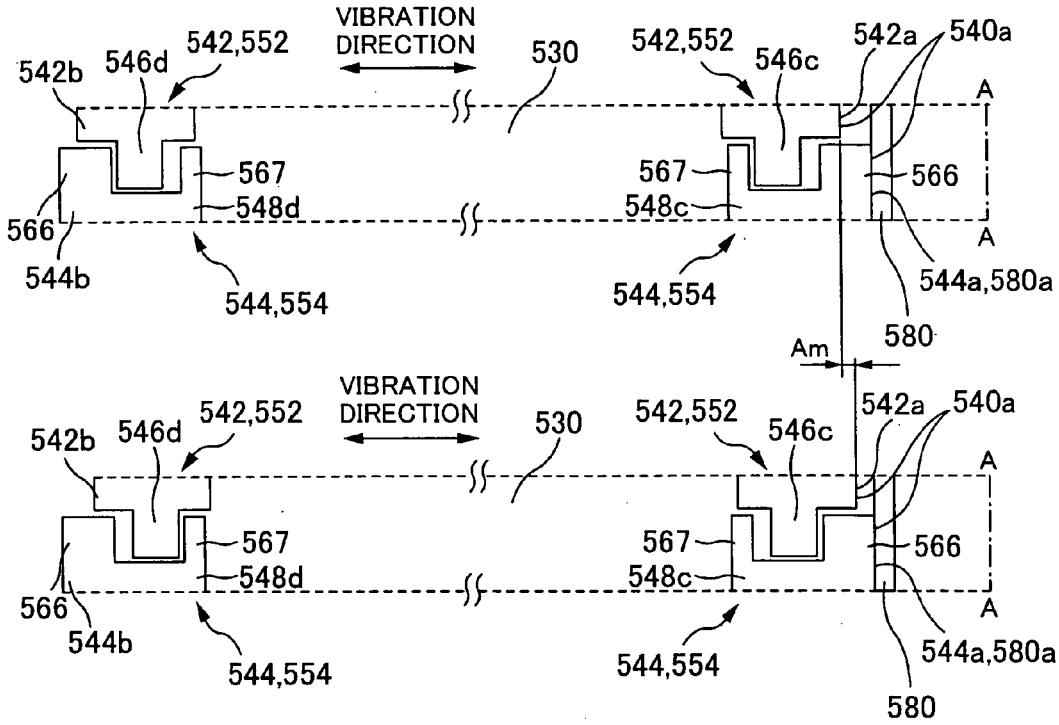
FIG. 19 is a schematic diagram showing a section view taken along line A-A of FIG. 14 according to the second embodiment.
Figure 20:
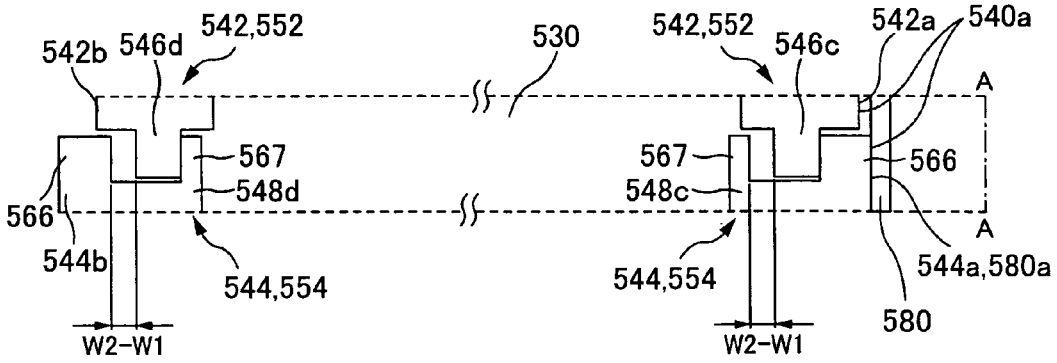
FIG. 20 is a schematic diagram showing a section view taken along line A-A of FIG. 14 according to the second embodiment.

Next, with reference to FIG. 15 through FIG. 20, the welding structure and the welding method of the housing 540 are described. FIG. 15 is an overall perspective view of the upper housing section 542 and the lower housing section 544 before they are welded together. FIG. 16 is a diagram schematically showing a portion of the surface of a first longitudinal protrusion 546*a* and a first longitudinal recess 548*a*. FIG. 17 is a section view schematically showing how the upper housing section 542 and the lower housing section 544 are placed on top of one another. FIG. 18 through FIG. 20 are conceptual diagrams showing section views taken along line A-A of FIG. 14.

As described above, the housing 540 is formed by welding together a plurality of integrally-molded housing sections, that is, an upper housing section 542 and a lower housing section 544.

As shown in FIG. 15, a protrusion 546 is provided at a welding section 552 (see FIG. 4) of the upper housing section 542 where it is welded to the lower housing section 544, and a recess 548 is provided at a welding section 554 (see FIG. 4) of the lower housing section 544 where it is welded to the upper housing section 542. The protrusion 546 includes a first longitudinal protrusion 546*a* and a second longitudinal protrusion 546*b* provided in the longitudinal direction of the yellow developing device 54, and a first lateral protrusion 546*c* and a second lateral protrusion 546*d* provided in a direction that is perpendicular to the longitudinal direction of the yellow developing device 54. Further, the recess 548 includes a first longitudinal recess 548*a* and a second longitudinal recess 548*b* provided in the longitudinal direction of the yellow developing device 54, and a first lateral recess 548*c* and a second lateral recess 548*d* provided in a direction that is perpendicular to the longitudinal direction of the yellow developing device 54. The housing 540 is formed by welding the protrusion 546 and the recess 548, more specifically, the first longitudinal protrusion 546*a* and the first longitudinal recess 548*a*, the second longitudinal protrusion 546*b* and the second longitudinal recess 548*b*, the first lateral protrusion 546*c* and the first lateral recess 548*c*, and the second lateral protrusion 546*d* and the second lateral recess 548*d*, to one another.

Below, the structure of the protrusion and the recess is described in more detail with reference to FIG. 16 and FIG. 17. It should be noted that in the description below, attention is paid only to the first longitudinal protrusion 546*a* and the first longitudinal recess 548*a*, but the description applies in the same way to the other protrusions (i.e., the second longitudinal protrusion 546*b*, the first lateral protrusion 546*c*, and the second lateral protrusion 546*d*) and the other recesses (i.e., the second longitudinal recess 548*b*, the first lateral recess 548*c*, and the second lateral recess 548*d*).

FIG. 16 shows a portion of the surface of the first longitudinal protrusion 546*a* and the first longitudinal recess 548*a*. The first longitudinal protrusion 546*a* of the upper housing section 542 is shown in the diagram on the right, and the first longitudinal recess 548*a* of the lower housing section 544 is shown in the diagram on the left. The upper housing section 542 and the lower housing section 544 are placed on top of one another and welded such that the alternate long-and-short dashed lines indicated by X in the right-side diagram and the left-side diagram match one another, and that the alternate long-and-short dashed lines indicated by Y in the right-side diagram and the left-side diagram match one another.

FIG. 17 is a section view showing how the upper housing section 542 and the lower housing section 544 are placed on top of one another. This is a section view of the upper housing section 542 and the lower housing section 544, which have been superposed, taken along either the alternate long-and-short dashed line X or Y described above. As shown in the figure, the upper housing section 542 is superposed on the lower housing section 544 in such a state that the first longitudinal protrusion 546*a* is fitted into the first longitudinal recess 548*a*.

It should be noted that as shown in FIG. 16 and FIG. 17, the outer wall 566 of the first longitudinal recess 548*a* is thicker than its inner wall 567. Here, the inner wall 567 of the recess 548 is the wall closer to the toner containing section 530 described above, and the outer wall of the recess 548 is the wall 566 farther from the toner containing section 530.

The method of welding the housing 540 is described next. The upper housing section 542 and the lower housing section 544 are welded together in the state described above, that is, the state in which the upper housing section 542 and the lower housing section 544 are placed on top of one another. In the present embodiment, so-called "vibration welding" is adopted as the welding method. In vibration welding, the upper housing section 542 is fixed to and held by an upper jig and the lower housing section 544 is fixed to and held by a lower jig, and in a state where the upper and lower housing sections 542 and 544 are pressed in contact with each other, the upper jig is vibrated by approximately 0.8 to 1.5 mm at a rate of 100 to 300 times per second in a direction along the longitudinal direction of the yellow developing device 54, that is, in the direction piercing through the paper face of FIG. 17. Due to this vibration, frictional heat is produced between the upper and lower housing sections 542 and 544. Due to this frictional heat, the protrusion 546 melts, and the protrusion 546 and the recess 548, that is, the upper housing section 542 and the lower housing section 544 are welded together. The melt, which is produced as a result of the protrusion 546 melting, is located in a gap between the protrusion 546 and the recess 548.

It should be noted that in the present embodiment, the predetermined vibration direction in which the upper housing section 542 is caused to vibrate during vibration welding is in the longitudinal direction of the yellow developing device 54, as described above. Therefore, the first longitudinal protrusion 546*a* and the second longitudinal protrusion 546*b* correspond to the "vibration-direction protrusions" which are arranged in the predetermined vibration direction of the vibration that is applied to the upper housing section 542 during vibration welding, and the first lateral protrusion 546*c* and the second lateral protrusion 546*d* correspond to the "perpendicular-direction protrusions" which are arranged in a direction perpendicular to the vibration direction. Similarly, the first longitudinal recess 548*a* and the second longitudinal recess 548*b* correspond to the "vibration-direction recesses" which are arranged in the predetermined vibration direction of the vibration that is applied to the upper housing section 542 during vibration welding, and the first lateral recess 548*c* and the second lateral recess 548*d* correspond to the "perpendicular-direction recesses" which are arranged in a direction perpendicular to the vibration direction.

Now, with reference to FIG. 18, the length etc. of the housing 540 in the vibration direction (the longitudinal direction of the yellow developing device 54 in the present embodiment) is considered. FIG. 18 is a schematic diagram showing a section view taken along line A-A of FIG. 14. As shown in FIG. 18, the first lateral protrusion 546*c* and the first lateral recess 548*c*, and the second lateral protrusion 546*d* and the second lateral recess 548*d* are arranged along section A-A of FIG. 14 such that they sandwich the toner containing section 530 therebetween. On the side surface 540*a* of the housing 540 that intersects with the vibration direction, the shaft-receiving member 580 is provided extending across the upper housing section 542 and the lower housing section 544 in a state where the second side surface 544*a* and the side surface 580*a*, of among the side surfaces of the shaft-receiving member 580, that is closer to the housing 540 are placed in contact with one another.

The length L1 from the first side surface 542*a* up to a first opposite-side side surface 542*b*, which is on the opposite side from the first side surface 542*a*, is shorter than the length L2 from the second side surface 544*a* up to a second opposite-side side surface 544*b*, which is on the opposite side from the second side surface 544*a*. In this way, it is possible to appropriately prevent physical interference between the upper housing section 542, which is an example of a first housing section, and the shaft-receiving member 580, which is an example of an attachment member.

That is, as described in the "Description of the Related Art", the shaft-receiving member 580 is attached to the lower housing section 544, and is provided extending across the upper housing section 542 and the lower housing section 544 on the side surface 540*a* of the housing 540 that intersects with the vibration direction. Due to this structure, if the upper housing section 542 physically interferes with the shaft-receiving member 580 when this is attached to the lower housing section 544, then the shaft-receiving member 580 may become deformed.

On the other hand, in the present embodiment, the length L1 from the first side surface 542*a* to the first opposite-side side surface 542*b* is shorter than the length L2 from the second side surface 544*a* to the second opposite-side side surface 544*b*. Accordingly, physical interference between the upper housing section 542 and the shaft-receiving member 580 (that is, interference between the first side surface 542*a* and the side surface 580*a*, of among the side surfaces of the shaft-receiving member 580, that is closer to the housing 540 in FIG. 18) is appropriately prevented when the shaft-receiving member 580 is attached to the lower housing section 544, and moreover, the deformation of the shaft-receiving member 580 can be avoided.

Further, in the present embodiment, the difference L2−L1 between the length L1 and the length L2 is larger than an amplitude value Am of the vibration that is applied to the upper housing section 542 during the vibration welding. In this way, it is possible to prevent, more reliably, the upper housing section 542 from physically interfering with the shaft-receiving member 580 when the shaft-receiving member 580 is attached to the lower housing section 544.

As described above, in vibration welding, the upper housing section 542 is fixed to and held by the upper jig and the lower housing section 544 is fixed to and held by the lower jig, and the upper jig (the upper housing section 542) is vibrated in the vibration direction. The relative position of the upper housing section 542 with respect to the lower housing section 544 of the housing 540 obtained by vibration welding can be controlled, for example, by means for adjusting the timing at which the vibration of the upper housing section 542 is stopped. However, the actual relative position of the vibration-welded housing 540 may deviate from a desired relative position.

In view of this, the difference L2−L1 between the length L1 and the length L2 is made larger than the amplitude value Am of the vibration. In this way, it is possible to appropriately prevent the upper housing section 542 from physically interfering with the shaft-receiving member 580 when the shaft-receiving member 580 is attached to the lower housing section 544, even when there is a deviation in the relative position. FIG. 19 shows a state in which the relative position of the upper housing section 542 to the lower housing section 544 is furthest to the left in the figure when the upper housing section 542 has vibrated in the vibration direction (the upper diagram), and a state in which the relative position is furthest to the right in the figure (the lower diagram). For example, even if the housing 540 is formed by the upper housing section 542 and the lower housing section 544 being welded together in either of those states, the upper housing section 542 is appropriately prevented from physically interfering with the shaft-receiving member 580.

Furthermore, in the present embodiment, the difference L2−L1 between the length L1 and the length L2 is larger than the difference W2−W1 between the distance W2, in the vibration direction, from the inner wall 567 to the outer wall 566 of the first lateral recess 548*c* (or the second lateral recess 548*d*) and the thickness W1, in the vibration direction, of the first lateral protrusion 546*c* (or the second lateral protrusion 546*d*). In this way, it is possible to prevent, even more reliably, the upper housing section 542 from physically interfering with the shaft-receiving member 580 when the shaft-receiving member 580 is attached to the lower housing section 544.

The amplitude value Am of the vibration relating to the vibration welding is set such that the protrusion of the upper housing section 542 does not come into contact with the inner wall 567 and the outer wall 566 of the recess of the lower housing section 544 when the upper housing section 542 is vibrated. Therefore, in this case, the amplitude value Am is set to a value smaller than the difference W2−W1 between the distance W2 and the thickness W1. However, the amplitude Am' of the vibration during actual vibration welding may deviate from the amplitude value Am that has been set, and for example, the amplitude Am' of the vibration during actual vibration welding may become larger than the amplitude value Am that has been set.

In view of this, the difference L2−L1 between the length L1 and the length L2 is made larger than the difference W2−W1 between the distance W2 and the thickness W1. In this way, even when a deviation occurs and the amplitude Am' of the vibration during actual vibration welding becomes larger than the amplitude value Am that has been set, it is possible to appropriately prevent the upper housing section 542 from physically interfering with the shaft-receiving member 580 when the shaft-receiving member 580 is attached to the lower housing section 544. For example, there is a possibility that the amplitude Am' of the vibration during actual vibration welding exceeds the amplitude value Am that has been set and becomes equal to the difference W2−W1, and the upper housing section 542 and the lower housing section 544 become welded in such a state that the protrusion 546 of the upper housing section 542 is placed in contact with the outer wall 566 or the inner wall 567 of the recess 548 of the lower housing section 544, as shown in FIG. 20. Even in such a case, the upper housing section 542 is appropriately prevented from physically interfering with the shaft-receiving member 580.

===(2) Other Considerations===

In the foregoing embodiment, the upper jig, among the upper and the lower jigs, was caused to vibrate, but the lower jig may be vibrated instead.

Further, in the foregoing embodiment, a difference L2−L1 between the length L1 from the first side surface 542*a* up to the first opposite-side side surface 542*b* and the length L2 from the second side surface 544*a* up to the second opposite-side side surface 544*b* was larger than an amplitude value Am of the vibration that is applied to the upper housing section 542 during the vibration welding. This, however, is not a limitation, and for example, the difference L2−L1 may be smaller than the amplitude value Am.

The foregoing embodiment, however, is more preferable in terms that it is possible to appropriately prevent physical interference between the upper housing section 542 and the shaft-receiving member 580 when the shaft-receiving member 580 is attached to the lower housing section 544, even when the relative position of the upper housing section 542 to the lower housing section 544 of the housing 540 obtained by vibration welding deviates from the desired relative position as described above.

Further, in the foregoing embodiment, the upper housing section 542 was provided with a protrusion 546, and the lower housing section 544 was provided with a recess 548; and the protrusion 546 and the recess 548 were welded together through vibration welding in a state where the protrusion 546 is fitted into the recess 548. This, however, is not a limitation, and for example, the protrusion 546 and the recess 548 do not have to be provided.

The foregoing embodiment, however, is more preferable in terms that vibration welding of the housing 540 can be performed more conveniently and appropriately.

Further, in the foregoing embodiment, the upper housing section 542 was provided with the protrusion 546, and the lower housing section 544 was provided with the recess 548, but the recess 548 may be provided in the upper housing section 542 and the protrusion 546 may be provided on the lower housing section 544.

Further, in the foregoing embodiment, the upper housing section 542 included: a vibration-direction protrusion arranged in the vibration direction, and a perpendicular-direction protrusion arranged in a direction that is perpendicular to the vibration direction; the lower housing section 544 included: a vibration-direction recess arranged in the vibration direction, and a perpendicular-direction recess arranged in the direction perpendicular to the vibration direction; the vibration-direction protrusion and the vibration-direction recess were welded together through vibration welding in a state where the vibration-direction protrusion is fitted into the vibration-direction recess; the perpendicular-direction protrusion and the perpendicular-direction recess were welded together through vibration welding in a state where the perpendicular-direction protrusion is fitted into the perpendicular-direction recess; and the difference L2−L1 between the length L1 from the first side surface 542*a* up to the first opposite-side side surface 542*b* and the length L2 from the second side surface 544*a* up to the second opposite-side side surface 544*b* was larger than a difference W2−W1 between a distance W2, in the vibration direction, from an inner wall 567 to an outer wall 566 of the perpendicular-direction recess and a thickness W1 of the perpendicular-direction protrusion in the vibration direction. This, however, is not a limitation, and for example, the difference L2−L1 may be smaller than the difference W2−W1.

The foregoing embodiment, however, is more preferable in terms that it is possible to appropriately prevent physical interference between the upper housing section 542 and the shaft-receiving member 580 when the shaft-receiving member 580 is attached to the lower housing section 544, even when the amplitude Am' of the vibration when performing vibration welding becomes larger than the amplitude value Am that has been set as described above.

Further, in the foregoing embodiment, the shaft-receiving member 580 was in contact with the second side surface 544*a*. This, however, is not a limitation, and the shaft-receiving member 580 does not have to be in contact with the second side surface 544*a*. Further, a normal direction of a side surface 580*a*, of among side surfaces of the shaft-receiving member 580, that is closer to the housing 540 was in a normal direction of the second side surface 544*a*. This, however, is not a limitation, and it does not have to be in the normal direction of the second side surface 544*a*.

Further, in the foregoing embodiment, the vibration direction was in a longitudinal direction of the developing device This, however, is not a limitation, and for example, the vibration direction may be in the lateral direction of the developing device.

The foregoing embodiment, however, is more preferable in terms that vibration welding of the housing can be performed more conveniently and appropriately.

Further, in the above, a developing device was described as an example of the developer containing device. This, however, is not a limitation, and the developer containing device may be any kind of device as long as it can contain a developer. For example, the present invention is applicable to a cleaning unit 75 that is provided with a cleaning blade 76 and that contains the toner T that has been removed by the cleaning blade 76.

Further, in the above, a shaft-receiving member 580 was described as an example of the attachment member. This, however, is not a limitation, and the attachment member may be any kind of component as long as it is attached to the second housing section and is provided extending across the first housing section and the second housing section on a side surface of the housing that intersects with the vibration direction.

Further, in the foregoing embodiment, the attachment member was provided on one side surface of the housing that intersects with the vibration direction. This, however, is not a limitation, and it may be provided on both side surfaces thereof.

OTHER EMBODIMENTS

In the foregoing, a developer containing device etc. of the present invention was described according to embodiments thereof. However, the foregoing embodiments of the invention are for the purpose of elucidating the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to various types of image forming apparatuses, such as full-color laser beam printers that are not of the intermediate transferring type, monochrome laser beam printers, copying machines, and facsimiles.

Further, the photoconductor is not limited to a so-called photoconductive roller having a structure in which a photoconductive layer is provided on the outer peripheral surface of a cylindrical, electrically-conductive base. The photoconductor can be a so-called photoconductive belt structured by providing a photoconductive layer on a surface of a belt-like electrically-conductive base, for example.

CONFIGURATION OF IMAGE FORMING SYSTEM

Next, an embodiment of an image forming system, which serves as an example of an embodiment of the present invention, is described with reference to the drawings.

Figure 21:
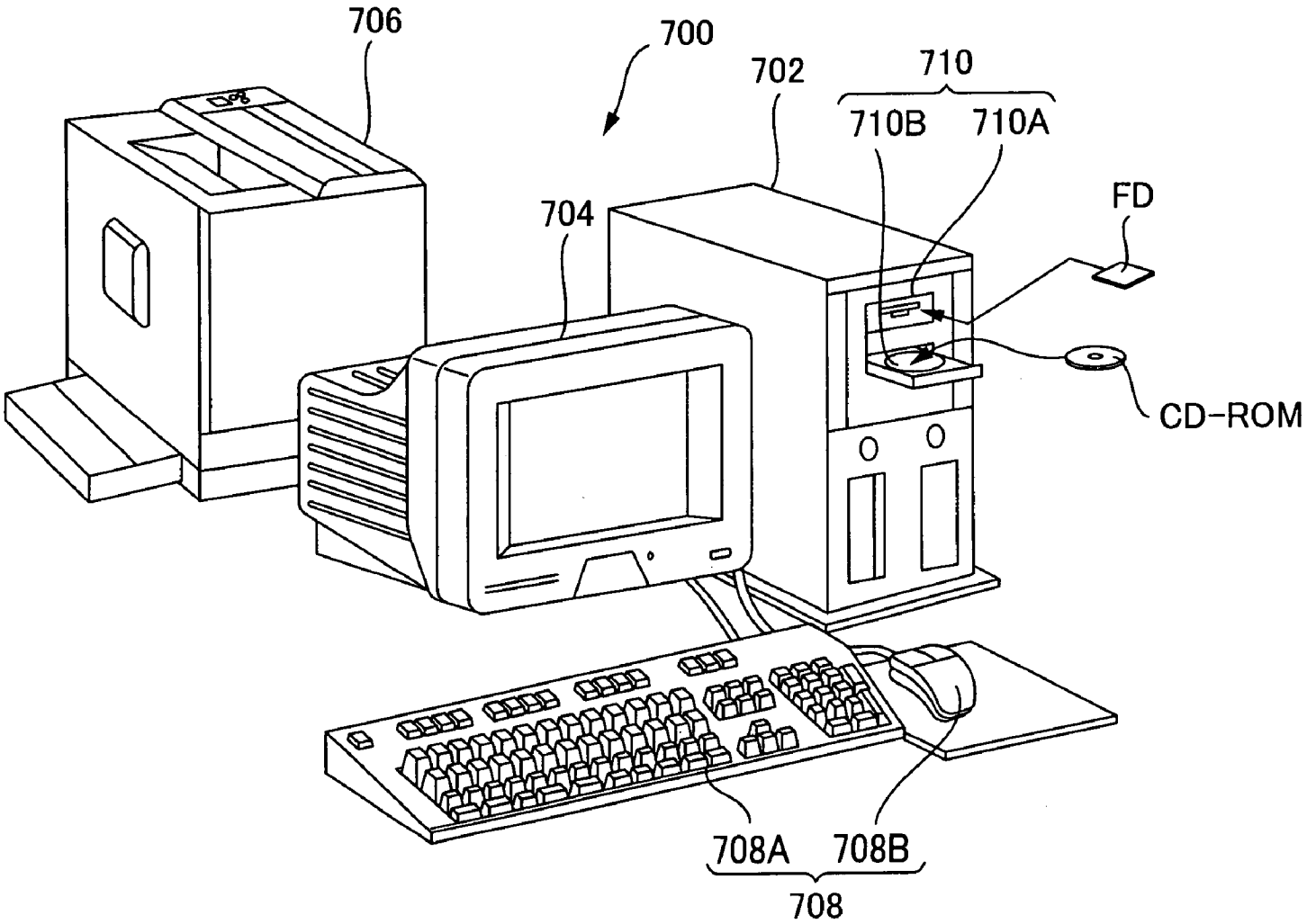
FIG. 21 is an explanatory drawing showing an external structure of an image forming system.

FIG. 21 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 22:
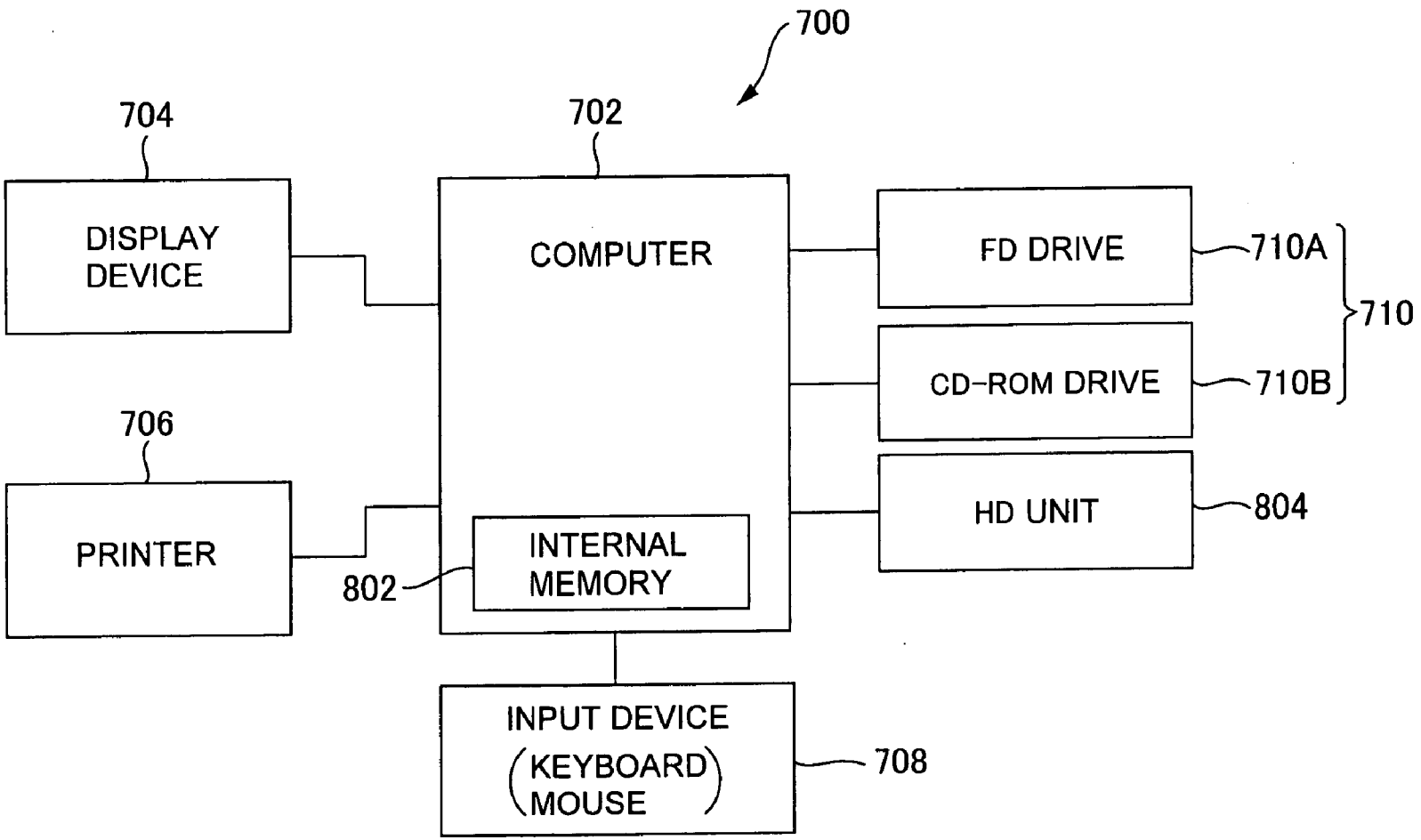
FIG. 22 is a block diagram showing a configuration of the image forming system shown in FIG. 21.

FIG. 22 is a block diagram showing a configuration of the image forming system shown in FIG. 21. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the-like are inserted and taken out.

As an overall system, the image forming system that is achieved in this way becomes superior to conventional systems.

What is claimed is:

1. A developer containing device comprising:

a housing that includes a first housing section and a second housing section and that is configured to contain a developer, wherein a protrusion provided on said first housing section and a recess provided in said second housing section are welded together through vibration welding in a state where said protrusion is fitted into said recess, and wherein an outer wall of said recess is thicker than an inner wall of said recess, wherein said first housing section includes:

a vibration-direction protrusion arranged in a predetermined vibration direction of a vibration that is applied to at least one of said first housing section and said second housing section during said vibration welding; and a perpendicular-direction protrusion arranged in a direction that is perpendicular to said predetermined vibration direction;

wherein said second housing section includes:

a vibration-direction recess arranged in said predetermined vibration direction; and a perpendicular-direction recess arranged in the direction perpendicular to said predetermined vibration direction;

wherein said vibration-direction protrusion and said vibration-direction recess are welded together through vibration welding in a state where said vibration-direction protrusion is fitted into said vibration-direction recess;

wherein said perpendicular-direction protrusion and said perpendicular-direction recess are welded together through vibration welding in a state where said perpendicular-direction protrusion is fitted into said perpendicular-direction recess; and wherein an outer wall of at least one of said vibration-direction recess and said perpendicular-direction recess is thicker than an inner wall of that recess.

2. A developer containing device according to claim 1, wherein the outer wall of said perpendicular-direction recess is thicker than the inner wall of said perpendicular-direction recess.

3. A developer containing device according to claim 1, wherein said predetermined vibration direction is in a longitudinal direction of said developer containing device.

4. A developer containing device according to claim 1, wherein said developer containing device is attachable to and detachable from an image forming apparatus that forms an image using the developer contained in said developer containing device.

5. A developer containing device according to claim 1, wherein said developer containing device is provided with a developer bearing body for bearing the developer, and is a developing device that develops a latent image borne on an image bearing body using the developer borne on said developer bearing body.

6. A developer containing device according to claim 1, wherein said developer containing device is provided with a developer-removing member for removing the developer, and is a removed-developer containing device that contains the developer that has been removed by said developer-removing member.

7. A developer containing device comprising:

a housing that includes a first housing section and a second housing section and that is configured to contain a developer, wherein a protrusion provided on said first housing section and a recess provided in said second housing section are welded together through vibration welding in a state where said protrusion is fitted into said recess, and wherein an outer wall of said recess is thicker than an inner wall of said recess;

wherein said first housing section includes:

a vibration-direction protrusion arranged in a predetermined vibration direction of a vibration that is applied to at least one of said first housing section and said second housing section during said vibration welding; and a perpendicular-direction protrusion arranged in a direction that is perpendicular to said predetermined vibration direction;

wherein said second housing section includes:

a vibration-direction recess arranged in said predetermined vibration direction; and a perpendicular-direction recess arranged in the direction perpendicular to said predetermined vibration direction;

wherein said vibration-direction protrusion and said vibration-direction recess are welded together through vibration welding in a state where said vibration-direction protrusion is fitted into said vibration-direction recess;

wherein said perpendicular-direction protrusion and said perpendicular-direction recess are welded together through vibration welding in a state where said perpendicular-direction protrusion is fitted into said perpendicular-direction recess;

wherein an outer wall of at least one of said vibration-direction recess and said perpendicular-direction recess is thicker than an inner wall of that recess;

wherein the outer wall of said perpendicular-direction recess is thicker than the inner wall of said perpendicular-direction recess;

wherein said predetermined vibration direction is in a longitudinal direction of said developer containing device;

wherein said developer containing device is attachable to and detachable from an image forming apparatus that forms an image using the developer contained in said developer containing device; and wherein said developer containing device is provided with a developer bearing body for bearing the developer, and is a developing device that develops a latent image borne on an image bearing body using the developer borne on said developer bearing body.

8. An image forming apparatus comprising:

a developer containing device that is provided with a housing that includes a first housing section and a second housing section and that is configured to contain a developer, wherein a protrusion provided on said first housing section and a recess provided in said second housing section are welded together through vibration welding in a state where said protrusion is fitted into said recess, and wherein an outer wall of said recess is thicker than an inner wall of said recess, wherein said first housing section includes:

a vibration-direction protrusion arranged in a predetermined vibration direction of a vibration that is applied to at least one of said first housing section and said second housing section during said vibration welding; and a perpendicular-direction protrusion arranged in a direction that is perpendicular to said predetermined vibration direction;

wherein said second housing section includes:

a vibration-direction recess arranged in said predetermined vibration direction; and a perpendicular-direction recess arranged in the direction perpendicular to said predetermined vibration direction;

wherein said vibration-direction protrusion and said vibration-direction recess are welded together through vibration welding in a state where said vibration-direction protrusion is fitted into said vibration-direction recess;

wherein said perpendicular-direction protrusion and said perpendicular-direction recess are welded together through vibration welding in a state where said perpendicular-direction protrusion is fitted into said perpendicular-direction recess; and wherein an outer wall of at least one of said vibration-direction recess and said perpendicular-direction recess is thicker than an inner wall of that recess.

9. An image forming system comprising:

a computer; and an image forming apparatus that is configured to be connected to said computer and that includes a developer containing device provided with a housing that includes a first housing section and a second housing section and that is configured to contain a developer, wherein a protrusion provided on said first housing section and a recess provided in said second housing section are welded together through vibration welding in a state where said protrusion is fitted into said recess, and wherein an outer wall of said recess is thicker than an inner wall of said recess, wherein said first housing section includes:

a vibration-direction protrusion arranged in a predetermined vibration direction of a vibration that is applied to at least one of said first housing section and said second housing section during said vibration welding; and a perpendicular-direction protrusion arranged in a direction that is perpendicular to said predetermined vibration direction;

wherein said second housing section includes:

a vibration-direction recess arranged in said predetermined vibration direction; and a perpendicular-direction recess arranged in the direction perpendicular to said predetermined vibration direction;

wherein said vibration-direction protrusion and said vibration-direction recess are welded together through vibration welding in a state where said vibration-direction protrusion is fitted into said vibration-direction recess;

wherein said perpendicular-direction protrusion and said perpendicular-direction recess are welded to&ether through vibration welding in a state where said perpendicular-direction protrusion is fitted into said perpendicular-direction recess; and wherein an outer wall of at least one of said vibration-direction recess and said perpendicular-direction recess is thicker than an inner wall of that recess.

10. A developer containing device comprising:

a housing that includes a first housing section and a second housing section and that is configured to contain a developer, wherein said first housing section and said second housing section are welded together through vibration welding; and an attachment member that is attached to said second housing section, and that is provided extending across said first housing section and said second housing section on a side surface of said housing that intersects with a predetermined vibration direction of a vibration that is applied to at least one of said first housing section and said second housing section during said vibration welding;

wherein a length from a first side surface of said first housing section up to a first opposite-side side surface that is on the opposite side from said first side surface is shorter than a length from a second side surface of said second housing section up to a second opposite-side side surface that is on the opposite side from said second side surface, said first side surface and said second side surface being a portion of said side surface on which said attachment member is provided.

11. A developer containing device according to claim 10, wherein a difference between the length from said first side surface up to said first opposite-side side surface and the length from said second side surface up to said second opposite-side side surface is larger than an amplitude value of the vibration that is applied to at least one of said first housing section and said second housing section during said vibration welding.

12. A developer containing device according to claim 11, wherein either one of said first housing section and said second housing section is provided with a protrusion, and the other is provided with a recess; and wherein said protrusion and said recess are welded together through vibration welding in a state where said protrusion is fitted into said recess.

13. A developer containing device according to claim 12, wherein said first housing section includes:

a vibration-direction protrusion arranged in said vibration direction; and a perpendicular-direction protrusion arranged in a direction that is perpendicular to said vibration direction;

wherein said second housing section includes:

a vibration-direction recess arranged in said vibration direction; and a perpendicular-direction recess arranged in the direction perpendicular to said vibration direction;

wherein said vibration-direction protrusion and said vibration-direction recess are welded together through vibration welding in a state where said vibration-direction protrusion is fitted into said vibration-direction recess;

wherein said perpendicular-direction protrusion and said perpendicular-direction recess are welded together through vibration welding in a state where said perpendicular-direction protrusion is fitted into said perpendicular-direction recess; and wherein the difference between the length from said first side surface up to said first opposite-side side surface and the length from said second side surface up to said second opposite-side side surface is larger than a difference between a distance, in said vibration direction, from an inner wall to an outer wall of said perpendicular-direction recess and a thickness of said perpendicular-direction protrusion in said vibration direction.

14. A developer containing device according to claim 10, wherein said attachment member is in contact with said second side surface.

15. A developer containing device according to claim 14, wherein a normal direction of a side surface, of among side surfaces of said attachment member, that is closer to said housing is in a normal direction of said second side surface.

16. A developer containing device according to claim 10, wherein said vibration direction is in a longitudinal direction of said developer containing device.

17. A developer containing device according to claim 10, wherein said developer containing device is provided with a developer bearing body for bearing the developer, and is a developing device that develops a latent image borne on an image bearing body using the developer borne on said developer bearing body.

18. A developer containing device according to claim 17, wherein said developer bearing body has a rotation shaft; and wherein said attachment member is a shaft-receiving member for receiving said rotation shaft.

19. A developer containing device comprising:

a housing that includes a first housing section and a second housing section and that is configured to contain a developer, wherein said first housing section and said second housing section are welded together through vibration welding; and an attachment member that is attached to said second housing section, and that is provided extending across said first housing section and said second housing section on a side surface of said housing that intersects with a predetermined vibration direction of a vibration that is applied to at least one of said first housing section and said second housing section during said vibration welding;

wherein a length from a first side surface of said first housing section up to a first opposite-side side surface that is on the opposite side from said first side surface is shorter than a length from a second side surface of said second housing section up to a second opposite-side side surface that is on the opposite side from said second side surface, said first side surface and said second side surface being a portion of said side surface on which said attachment member is provided;

wherein a difference between the length from said first side surface up to said first opposite-side side surface and the length from said second side surface up to said second opposite-side side surface is larger than an amplitude value of the vibration that is applied to at least one of said first housing section and said second housing section during said vibration welding;

wherein either one of said first housing section and said second housing section is provided with a protrusion, and the other is provided with a recess;

wherein said protrusion and said recess are welded together through vibration welding in a state where said protrusion is fitted into said recess;

wherein said first housing section includes:

a vibration-direction protrusion arranged in said vibration direction; and a perpendicular-direction protrusion arranged in a direction that is perpendicular to said vibration direction;

wherein said second housing section includes:

a vibration-direction recess arranged in said vibration direction; and a perpendicular-direction recess arranged in the direction perpendicular to said vibration direction;

wherein said vibration-direction protrusion and said vibration-direction recess are welded together through vibration welding in a state where said vibration-direction protrusion is fitted into said vibration-direction recess;

wherein said perpendicular-direction protrusion and said perpendicular-direction recess are welded together through vibration welding in a state where said perpendicular-direction protrusion is fitted into said perpendicular-direction recess;

wherein the difference between the length from said first side surface up to said first opposite-side side surface and the length from said second side surface up to said second opposite-side side surface is larger than a difference between a distance, in said vibration direction, from an inner wall to an outer wall of said perpendicular-direction recess and a thickness of said perpendicular-direction protrusion in said vibration direction;

wherein said attachment member is in contact with said second side surface;

wherein a normal direction of a side surface, of among side surfaces of said attachment member, that is closer to said housing is in a normal direction of said second side surface;

wherein said vibration direction is in a longitudinal direction of said developer containing device;

wherein said developer containing device is provided with a developer bearing body for bearing the developer, and is a developing device that develops a latent image borne on an image bearing body using the developer borne on said developer bearing body;

wherein said developer bearing body has a rotation shaft; and wherein said attachment member is a shaft-receiving member for receiving said rotation shaft.

20. An image forming apparatus comprising:

a developer containing device that is provided with:

a housing that includes a first housing section and a second housing section and that is configured to contain a developer, wherein said first housing section and said second housing section are welded together through vibration welding; and an attachment member that is attached to said second housing section, and that is provided extending across said first housing section and said second housing section on a side surface of said housing that intersects with a predetermined vibration direction of a vibration that is applied to at least one of said first housing section and said second housing section during said vibration welding;

wherein a length from a first side surface of said first housing section up to a first opposite-side side surface that is on the opposite side from said first side surface is shorter than a length from a second side surface of said second housing section up to a second opposite-side side surface that is on the opposite side from said second side surface, said first side surface and said second side surface being a portion of said side surface on which said attachment member is provided.

21. An image forming system comprising:

a computer; and an image forming apparatus that is configured to be connected to said computer and that includes a developer containing device provided with:

a housing that includes a first housing section and a second housing section and that is configured to contain a developer, wherein said first housing section and said second housing section are welded together through vibration welding; and an attachment member that is attached to said second housing section, and that is provided extending across said first housing section and said second housing section on a side surface of said housing that intersects with a predetermined vibration direction of a vibration that is applied to at least one of said first housing section and said second housing section during said vibration welding;

wherein a Length from a first side surface of said first housing section up to a first opposite-side side surface that is on the opposite side from said first side surface is shorter than a length from a second side surface of said second housing section up to a second opposite-side side surface that is on the opposite side from said second side surface, said first side surface and said second side surface being a portion of said side surface on which said attachment member is provided.

* * * * *